US007093570B2

(12) United States Patent
Mavinahally et al.

(10) Patent No.: US 7,093,570 B2
(45) Date of Patent: Aug. 22, 2006

(54) STRATIFIED SCAVENGED TWO-STROKE ENGINE

(76) Inventors: Nagesh S Mavinahally, 207 Brittany Park, Anderson, SC (US) 29621; Jay S. Veerathappa, 17137 Devonshire St., Northridge, CA (US) 91325

( * ) Notice: Subject to any disclaimer, the term of this patent is extended or adjusted under 35 U.S.C. 154(b) by 0 days.

(21) Appl. No.: 11/026,209

(22) Filed: Dec. 30, 2004

(65) Prior Publication Data

US 2005/0139179 A1 Jun. 30, 2005

Related U.S. Application Data

(60) Provisional application No. 60/533,477, filed on Dec. 31, 2003.

(51) Int. Cl.
*F02B 33/04* (2006.01)
*F02B 25/00* (2006.01)

(52) U.S. Cl. ..... 123/73 D; 123/73 PP

(58) Field of Classification Search ..... 123/65 V, 123/73 V, 73 PP, 73 D, 73 DA, 73 S, 73 A
See application file for complete search history.

(56) References Cited

U.S. PATENT DOCUMENTS 2,481,901 A * 9/1949 Bracke ..... 123/73 D
4,253,433 A 3/1981 Blair
5,379,732 A 1/1995 Mavinahally et al.
5,425,346 A 6/1995 Mavinahally
6,112,708 A 9/2000 Sawada et al.
6,240,886 B1 6/2001 Noguchi
6,289,856 B1 9/2001 Noguchi
6,408,805 B1 6/2002 Uenoyama et al.
6,491,006 B1 12/2002 Jonsson
6,513,466 B1 2/2003 Bignion et al.
2004/0040522 A1 3/2004 Mavinahally

FOREIGN PATENT DOCUMENTS

WO WO 92/12332 7/1992

* cited by examiner

*Primary Examiner*—Noah P. Kamen
(74) *Attorney, Agent, or Firm*—Steven J. Rosen

(57) ABSTRACT

A two-stroke internal combustion engine includes at least one gaseous communication charge passage between a crankcase chamber and a combustion chamber of the engine and a piston to open and close the top end of the passage and a rotary valve to open and close the lower end of the transfer passage. The air inlet port to the transfer passage for stratified scavenging is opened and closed by the crank-web that has passages and cutouts. The rotary valve replaces the one-way reed valve used in stratified scavenged and charged two-stroke engines. The air passes from the lower end of transfer passage to the top end and into the crankcase through the piston passage, alternatively air may also pass through the adjacent transfer passage directly or through a passage in the piston into the crankcase. A two-stroke engine also consists of a charge injection system controlled by the crank web eliminating the one-way valve.

11 Claims, 23 Drawing Sheets

STRATIFIED SCAVENGED TWO-STROKE ENGINE

CROSS-REFERENCE TO RELATED APPLICATIONS

This application claims the benefit of U.S. Provisional Patent Application Ser. No. 60/533,477 filed on Dec. 31, 2003, and entitled "STRATIFIED SCAVENGED TWO-STROKE ENGINE" which is hereby incorporated by reference in its entirety.

BACKGROUND OF THE INVENTION

Field of the Invention

The present invention relates to two stroke internal combustion engines and, particularly, to such engines with stratified scavenging.

A particular field of application of the invention is a two-stroke internal combustion engine. One application of the invention is to a small high speed two stroke engine, such as utilized in hand-held power equipment such as leaf blowers, string trimmers, hedge trimmers, also in wheeled vehicle applications such as mopeds, motorcycles, scooters, and in small outboard boat engines. The small two stroke engine has many desirable characteristics, including simplicity of construction, low cost of manufacturing, high power-to-weight ratios, high speed operational capability and, in many parts of the world, ease of maintenance.

Inherent drawbacks of two stroke engines are high emission levels and poor fuel economy due to short-circuit loss of fuel and air charge during the scavenging process. One drawback of the simple two-stroke engine is a loss of a portion of the fresh unburned fuel charge from the cylinder during the scavenging process. In the two-stroke engine, the homogeneous charge enters the cylinder through transfer ports during the scavenging process, when the exhaust port is also open. As such, some of the charge escapes through the exhaust port leading to high levels of hydrocarbons (HC) in the tailpipe. This leads to the poor fuel economy and high emission of unburned hydrocarbon, thus, rendering the simple two stroke engine difficult to comply with increasingly stringent governmental pollution restrictions. This drawback can be relieved by separating the scavenging of the cylinder, with fresh air, from the charging of the cylinder, with fuel. This separation can be achieved by having a buffer medium of air between the fresh charge and the burnt gas, during the scavenging process.

Several concepts and technologies have been proposed or tried to circumvent the short-circuit loss of fresh charge. Among these techniques are direct or indirect fuel injections, stratified scavenging, air-head, air assisted fuel injection, and compressed wave injection. Most of these technologies are either complex, expensive or need more parts. The fuel injection technology is not economical for small engines but air-head scavenging and stratified scavenging are promising.

An air-head scavenging system disclosed in U.S. Pat. No. 6,513,466 consists of an air channel leading into the storage space in the crankcase and has a reed valve. The filling time is very dependent on the pressure difference across the reed valve and is more likely dependent on engine speed and load. This may lead to an optimum performance only at a certain operating range of speed and load. The storage space may become a dead space when charge bypasses the storage space. U.S. Pat. Nos. 4,821,787, 6,112,708, and 6,367,432 describe reed valve controlled air passage in air-head scavenged two-stroke engines. The use of reed valves increases the cost and complexity and the performance is subject to quality of the reed valves. John Deere has used Reed valve controlled charge injection called compressed wave injection in the hand held application two-stroke engines. Again the use of reed in the engine can add cost and complexity to the engine.

It is desirable to have a simple two-stroke engine with fewer parts and that is easy to manufacture and assemble. It is also desirable to have an air volume high enough to improve the delivery ratio and scavenging and have asymmetric air inlet timing.

SUMMARY OF THE INVENTION

A two stroke internal combustion engine includes at least one transfer passage in gaseous communication between a crankcase chamber and a combustion chamber of the engine, an air passage through the crankcase to the crankcase chamber and in gaseous communication with a carburetor of the engine, and a rotatable circular disk rotatably connected to a crankshaft of the engine. At least one first rotary shut-off valve is located in a radially outermost section of the circular disk bordered by a periphery of the circular disk and operatively disposed between the transfer passage and the crankcase chamber for opening and closing gaseous communication between the transfer passage and the crankcase chamber. At least one second rotary shut-off valve is located on the circular disk bordered by a periphery of the circular disk and operatively disposed between the air passage and the transfer passage for opening and closing gaseous communication between the air passage and the transfer passage.

In the exemplary embodiment of the two stroke internal combustion engine the first and second rotary shut-off valves are operably located on the on the circular disk to close the air passage to the transfer passage when the transfer passage is open between the combustion chamber and the crankcase chamber and to close off the transfer passage between the combustion chamber and the crankcase chamber when the air passage is opened to the transfer passage. In a more particular exemplary embodiment of the two stroke internal combustion engine the rotatable circular disk is a crank web, the first rotary shut-off valve is a conical cut out sector in a periphery of the crank web, and the second rotary shut-off valve is a notched cut out in the periphery of the crank web. An engine incudes a cylinder having at least one transfer passage that is a channel in a cylinder bore. A top end of the channel opens into a combustion chamber of the cylinder and the lower end opens into a crankcase chamber of the engine. The top end is opened and closed by a piston operably disposed in the cyliner bore, where as the lower end is alternatively opened and closed into the ambient air by a rotary valve, which in one embodiment of the engine is a crank web. When the rotary valve opens the air inlet to the lower end of transfer passage, as the piston is moving upward, a piston passage in a piston skirt of the piston opens a transfer port into the crankcase. The piston passage may be a window in the piston or a special passage with a fluid diode type that will be described later. The crank web also alternatively opens the lower end of the transfer passage into the crankcase. Connection of transfer passage to air and crankcase is alternative and is accomplished by a groove and cut out in the crank web. A main charge is injected into the crankcase in a usual manner either through a piston-controlled inlet, rotary valve, or a reed valve system.

One embodiment of the engine includes quadruplet transfer passage having a lower end of a first transfer passages closest to an exhaust port is alternatively connected to the ambient air by the rotary valve. The top end of the first transfer passage is connected to an adjacent second transfer passage either through a cut out in the piston or directly through a connecting passage at the top between the first and second transfer passages. The quadruplet passage increases the total volume of air and air acts as a buffer medium in both the transfer passages. It also helps clear the fresh charge in the transfer passages from the previous cycle.

By controlling the lower of transfer passage during scavenging asymmetric timing may be accomplished by the use of rotary valve. Thus the lower end of the transfer passage closest to the exhaust port may be shut off early during the end of scavenging process and may also have delayed opening.

A total length of the transfer passage may be increased by having the transfer passage continue into the crankcase as a grove on the crankcase wall. By using the crank web as a rotary valve to open and close the air inlet to lower end of transfer passage and a window or passage in the piston to open and close the top end of transfer passage into the crankcase, asymmetric air inlet timing is achieved. Thus there is no need for reed valves in the engine disclosed herein.

In one embodiment of the engine, the crank web and passage in the piston has been used to effect three-way scavenging in which air enters the combustion chamber ahead of lean air-fuel charge followed by the rich air-fuel charge. In another embodiments of the engine the crank web and the passage in the piston control a rich charge, thus eliminating a reed valve used in John Deere's compressed wave injection engine and completely replacing it with the rotary valve.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 2:
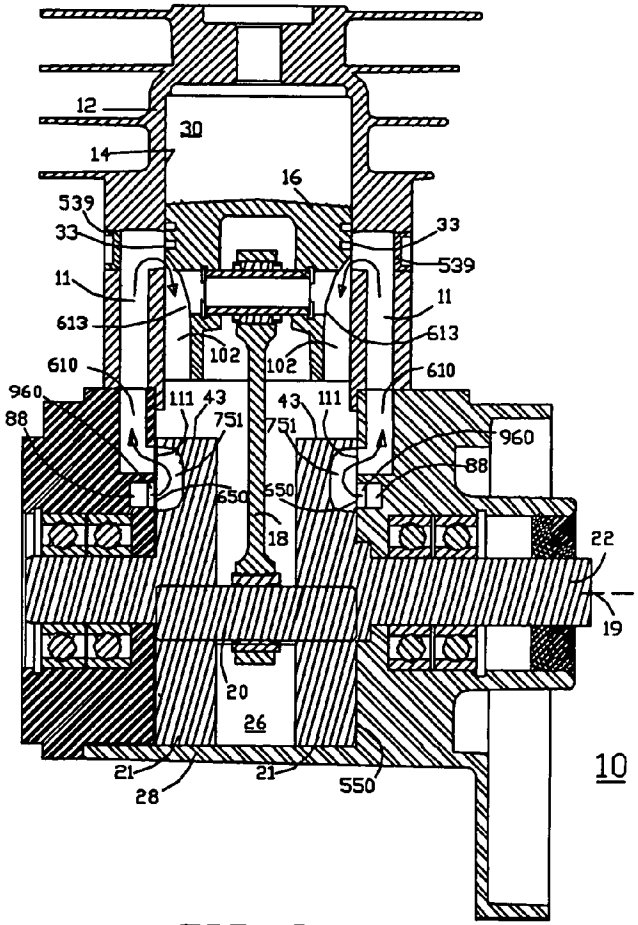
FIG. 2 is a section along the crankshaft of the engine 10 shown in FIG. 1.

Air-head scavenged engines provide a buffer medium of air between the fresh charge and the burned gas during the scavenging process. When the transfer ports open, the air enters the combustion chamber first and is most likely to be short-circuited, in the sense a small fraction of air is lost into the exhaust. The air is inducted into the transfer passage during the intake process, when the piston is ascending. Typically, a reed valve is provided at the top of the transfer passages for inducting only air into top of the transfer passages that stays in the transfer passages to act as a buffer medium. In some instances, piston ports are also provided in place of reed valves. The disadvantage with the reed valves is that it adds parts and are speed sensitive and the performance is subject to quality of the assembly of reeds and reed themselves.

In the exemplary embodiment the rotary valve, which can be a crank web as described in this case, replaces the reed valves. The two-stroke engine described in this embodiment consists of air inlet ports, opened and closed by the crank web cut out in the crank web for gaseous communication between the air inlet ports and the crankcase port at the bottom end of the transfer passages and the transfer ports at the top end of the transfer passages, which are opened and closed by the top of the piston and also by either cut out in the piston or by the passages in the piston. The cut out in the crank web acts as a rotary valve that periodically establishes gaseous communication between the ambient air and the transfer passages. The second cut out provides gaseous communication between the crankcase and the transfer passage. Thus the crank web alternatively communicates bottom end of the transfer passage with the ambient air and crankcase. The two-stroke engine cycle processes determine which way the bottom of transfer passage opens into.

The air inlet port is in gaseous communication with lower end of the transfer passage at appropriate time only. The timing of the gaseous communication between the air inlet port and the transfer passage is controlled by the passage in the crank web (could be groove or counter sunk). The crank web during the scavenging and expansion process shuts off the air inlet port. The lower end of the transfer passage is open and closed to the crankcase at appropriate time by the cutout on the crank web. Thus the crank web acts as a rotary valve to time the flow air into transfer passage from ambient during intake process and opens the transfer passage to crank case during scavenging process. The air in the transfer passage acts as a buffer medium between the charge and the burnt gas to minimize the loss of charge into exhaust and hence lowers the exhaust emission.

FIGS. 1 through 11 illustrate a dual transfer passage two-stroke engine 10, wherein there are two transfer passages 11 (and ports) one on each side of the exhaust port 50. A piston 16 is connected to the crankshaft 22 having a crankshaft axis 19 by a connecting rod 18. As the piston 16 moves upward after the exhaust port 50 is closed, the counter sunk passage 751 on the outer face 550 of the crank web 21 establishes a gaseous communication between the air inlet port 650 and the crankcase port 111 at the lower end of transfer passage 11. Around the same time the transfer port 33 is open into the crankcase 26 by the passage 613 in the piston 16. Thus the differential pressure between the crankcase and the ambient lets the air to flow into the transfer passage 11 through the carburetor 34, air control valve 94, passage 817 in the heat dam 134 and into the air passage 88 in the crankcase 28. Air continues to flow into the transfer passage as long as there is pressure difference across ambient and crankcase 26 and until the air inlet port 650 is shut off by the crank web 21. The gaseous communication between the crankcase port 111 and air inlet port 650 may be cut off either before the piston reaches TDC or slightly past TDC. The asymmetric timing of the air inlet port 650 is achievable by the location of trailing edge 687 and angular length B of the countersunk passage 751 on the crank web 21. By closing the crankcase port 111 during the down ward stroke of the piston, the reverse flow of air into the countersunk passage in the crank web and hence back into ambient is prevented. By virtue of long passage 102 in the piston, the entry of live charge from crankcase 26 into the transfer passage 11 may be prevented. Also, the inertia of the air flowing into the crankcase through the passage past TDC helps prevent reverse flow of air and or charge into the transfer passage.

As the piston descends, and before the top of the piston opens transfer port 33, the crankcase port 111 at the lower end of the transfer passage 11 is opened by the cut out 244 on the periphery 43 of the crank web 21. The location of leading edge 179 with respect to TDC position determines the start of scavenging process. The opening of the crankcase port 111 can be leading ahead or trailing behind the opening of the transfer port 33 by the piston. The angular length 'A' between the leading edge 179 and the trailing edge 178 determines the duration of the crankcase port 111 opened into the crankcase 26. The intake of main air-fuel charge occurs though the inlet port 84 and through the carburetor control valve 585 in a normal way. The opening of the intake port 84 may be delayed with respect to the air inlet port 650. A typical port timing for the exemplary air-head scavenged two-stroke engine is shown in Table 1.

As the piston descends down, it opens the exhaust port 50 first and then the transfer ports 33. When the transfer ports 33 are opened, the air in the transfer passage 11 enters the combustion chamber 30 first ahead of the charge. Thus pure air acts as a buffer medium between the burnt gas and the fresh charge during the scavenging process. Since air enters the combustion chamber first and has the longest path to travel in the combustion chamber, it is the one that is most likely to be lost into the exhaust port 50. Thus air-head scavenging minimizes the loss of fresh charge into the tail pipe and hence lowers the unburned hydrocarbon emission into the ambient. The scavenging duration by the charge may be delayed by delaying the opening of the crankcase port 111. Thus the duration of time for which charge is likely to escape into the exhaust port may be shortened as determined by the angular length 'A' of the cut out 244 in the crank web 21. Also, after discharging trapped air into the combustion chamber, the discharge of charge following the air may be momentarily interrupted by shutting off the crankcase port 111 by the crank web. In that case the cut out 244 is made of two segments; a first cut out 244*a* for the discharge of air through the port 33. After momentarily shutting the crankcase port 111 the second cut out 751 opens the crankcase port 111 for discharge of charge. Descending of piston toward BDC helps build up crankcase pressure when the crankcase port 111 is momentarily shut off. Increased crankcase pressure around BDC position of the piston helps the delayed discharge of charge into the combustion chamber.

Figure 7:
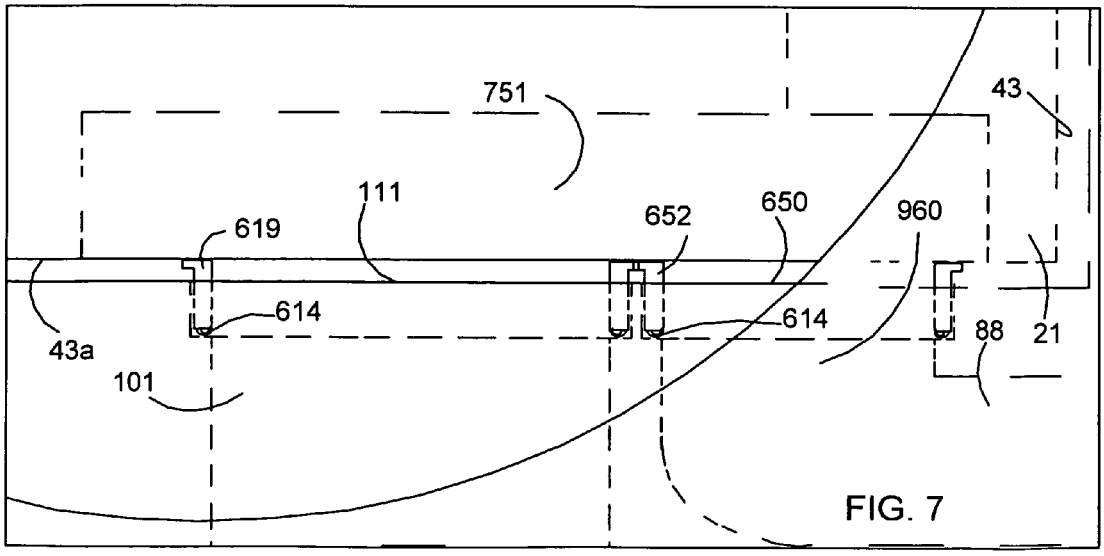
FIG. 7 is an enlarged view of crankcase ports with sealing inserts as viewed from top of crankcase.

The proper functioning of the rotary valve depends on the good clearance between the port and the rotary valve. If the clearance between the two is excessive it may lead to poor sealing. In order to ensure proper seal between the face 550 of the crank web 21 and the crankcase wall, unique inserts 619 and 652 have been used. FIGS. 7 and 8*a* show the air inlet port 650 and the crankcase port 111 with inserts 652 and 619 respectively in the corresponding ports. The insert is a small piece of tube inserted into the crankcase port 111 and the air inlet port 650. The front face of the insert always keeps pressed against the face of the rotary valve, ensuring a proper seal between the insert and the rotary valve. At the back of the insert is a spring 614 that presses the insert away from the crankcase. The outer face of the insert pressed against the crank web always rests on the uncut face of the crank web and as such it does not get caught in the cut out. The insert 652 may be made of a non-metallic material and the spring 614 may either be a separate piece or an integral of the insert 652. The inserts may be of soft material in comparison to the crank web. A high temperature plastic reinforced with glass fiber may be used.

Figure 9:
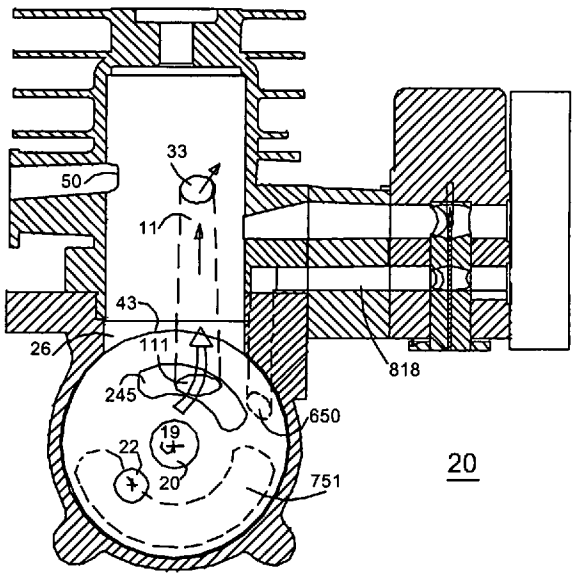
FIG. 9 is a section along the crankshaft of the engine 20 shown in FIG. 8.
Figure 8:
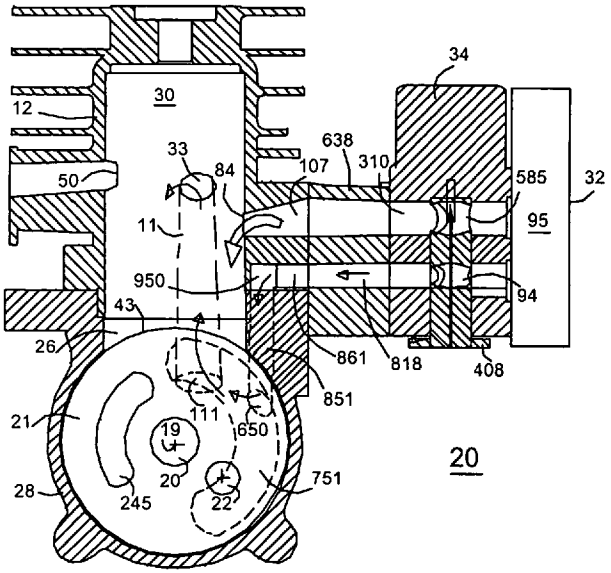
FIG. 8 is a longitudinal sectional view illustration of an exemplary embodiment of a two-stroke engine 20 with a rotary valve controlled air inlet system with air inlet open condition, has air channel in the cylinder flange (connecting rod and piston not shown).
Figure 8A:
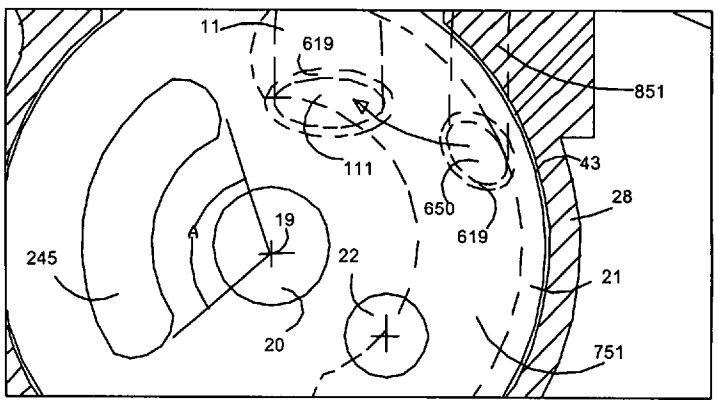
FIG. 8*a* is an enlarged view of crankcase inserts as viewed from the side.

FIGS. 8 and 9 show where the crank web 21 has a through passage 245 for uncovering the crankcase port 111 during the scavenging process. When the piston is ascending, the counter sunk passage 751 on the outer surface 550 of the crank web 21, establishes gaseous communication between the air inlet port 650 and the crankcase port 111 for filling the transfer passage 11 with air during intake process. In FIG. 8, 8*a*, and 9, the crankcase port 111 is at a lower position and the transfer passage 11 is longer than it is illustrated in FIGS. 1 through 4. The air inlet passage 818 in the heat dam 638 is a single through passage.

Figure 6:
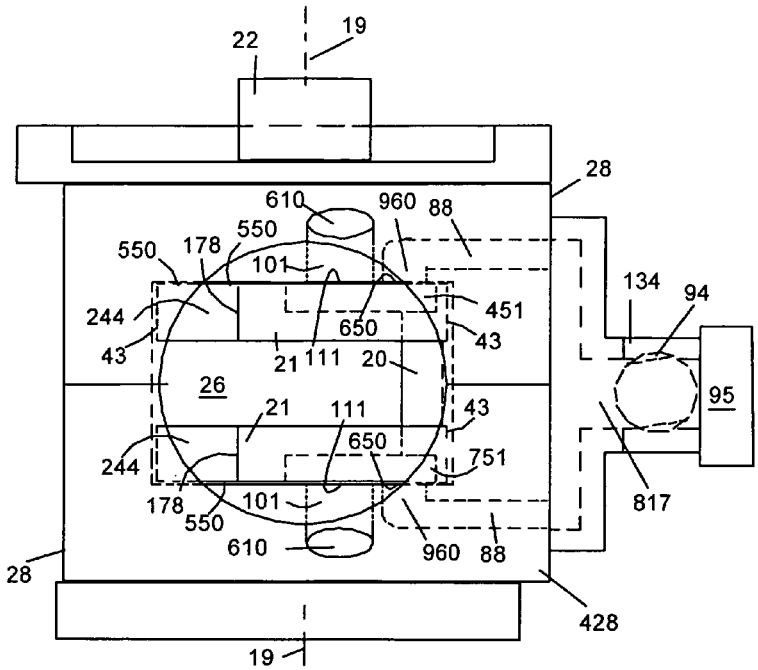
FIG. 6 is a top view of the crankcase of the engine shown in FIG. 5.
Figure 10:
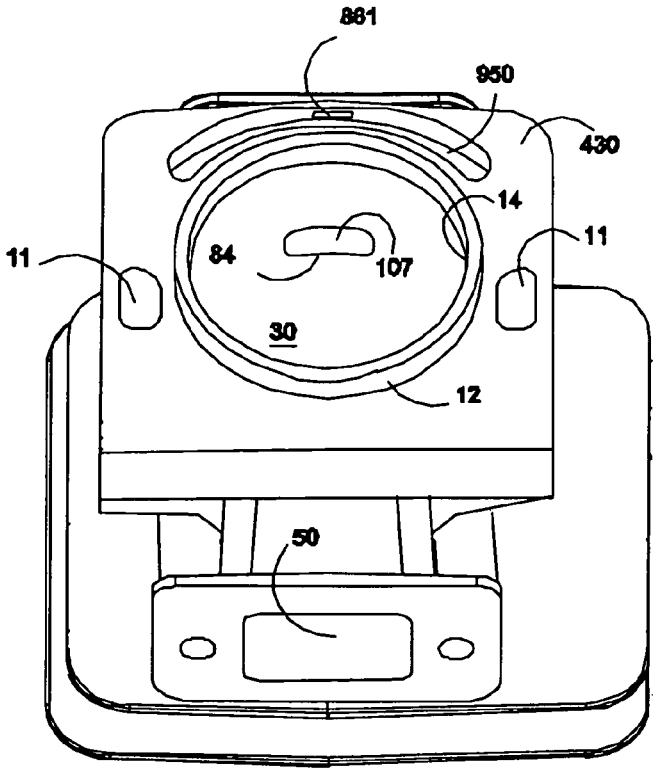
FIG. 10 is a bottom view of the cylinder of the engine 20 shown in FIG. 8.

FIGS. 8 through 10 show the air passage 861 splitting into left and right passages 950 on the cylinder flange 430 and then there is a air passage 851 in the crankcase 28 going down and opening into air inlet port 650, through a passage 960 (shown in FIGS. 6 and 7). The advantage is that the carburetor 34 containing control valves 585 for air-fuel and 94 for pure air is more compact. The adapter 638 between the carburetor 34 and the cylinder 12 is also small.

Figure 11:
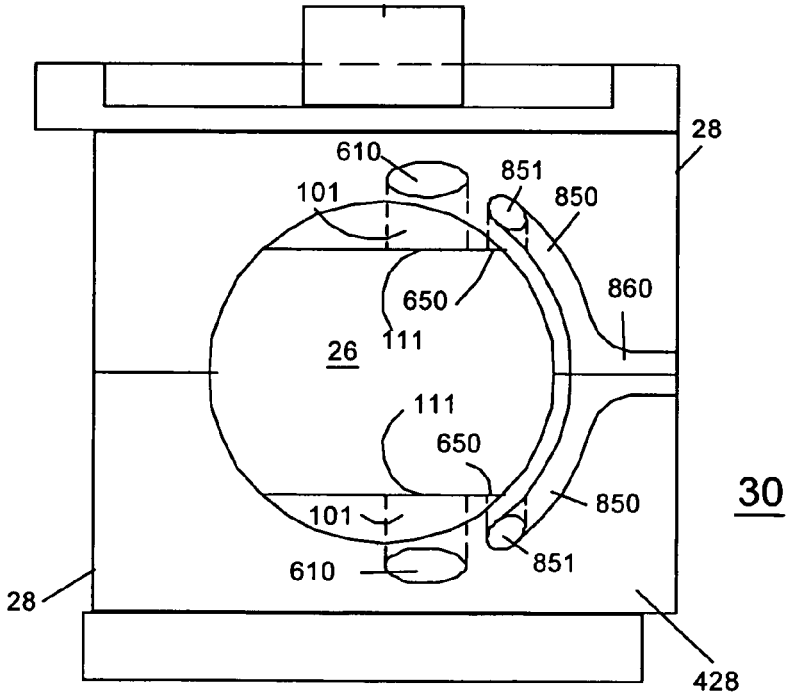
FIG. 11 is a top view illustration of crankcase of an exemplary embodiment of a two-stroke engine 30 with air channel in the crankcase flange.

FIG. 11 shows where the air inlet passage 860 is in the crankcase splitting into left and right passages 850 in crankcase flange 428. The air passage 850 opens into the passage 851 going down into the crankcase passage 960 (shown in FIGS. 6 and 7) that runs along the crankshaft axis 19, and into the air inlet port 650.

Figure 13:
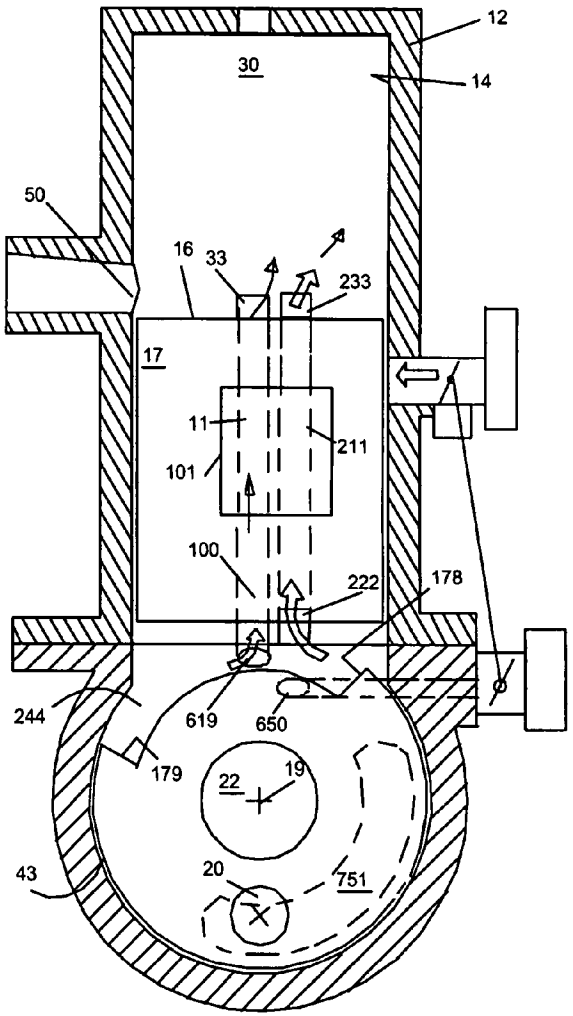
FIG. 13 is a view illustration of FIG. 12 with air inlet closed and lower end of both the transfer passages open to crankcase.
Figure 12:
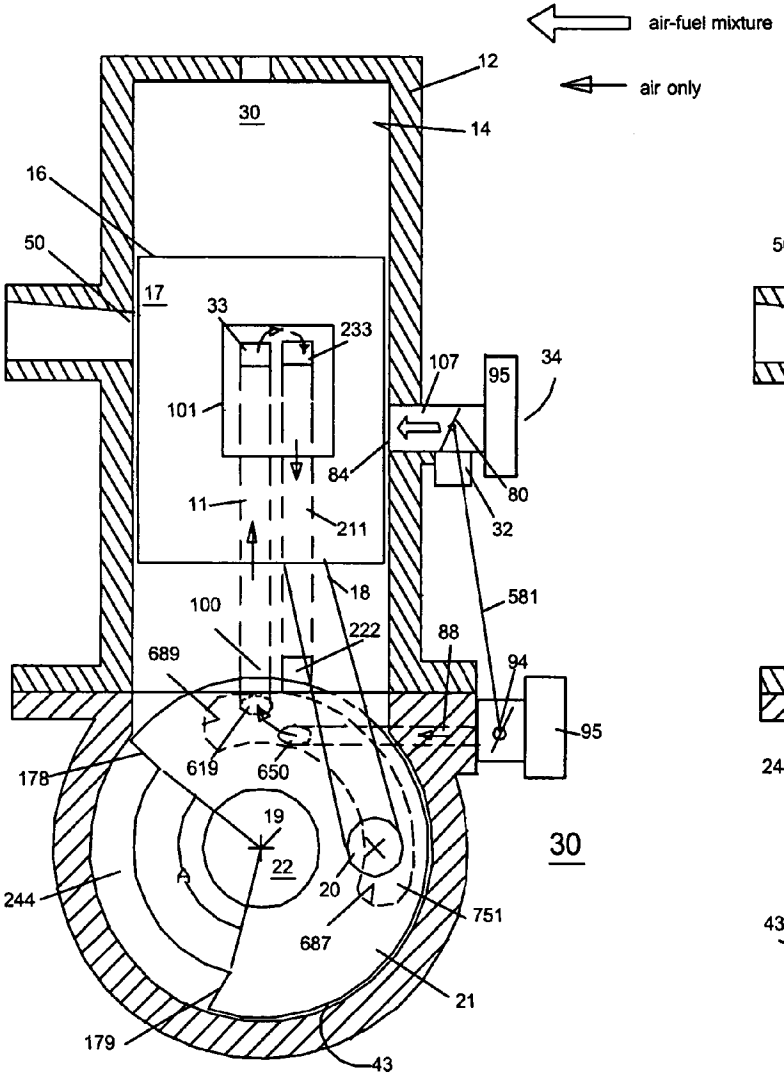
FIG. 12 is a longitudinal sectional view illustration of an exemplary embodiment of a two-stroke engine 40 with quadruplet transfer passages and rotary valve controlled air inlet system with air inlet open condition, has passage in the piston connecting each other at the top of two transfer passages.

FIGS. 12 through 16 illustrate quadruplet transfer passage system in a two-stroke engine. In the quadruplet transfer passages, there are four transfer passages one pair on each side of the exhaust port 50. The air is inlet into the crankcase port 650 at lower end 100 of the transfer passage 11, which is closest to the exhaust port 50. However, the air instead of flowing out of transfer port 33 into the crankcase 26, it flows into the adjacent transfer passage 211. The transfer ports 33 and 233 are in gaseous communication with each other through passage 101 in the piston 16. FIG. 17(*e*) illustrates the passage in the piston. Where as in FIG. 16, the gaseous communication between the transfer passages 11 and 211 is through a direct passage 543 between the two passages. As the piston ascends the passage 101 in the piston 16 establishes at an appropriate time the communication between the adjacent transfer passages 11 and 211 through transfer ports 33 and 233. Thus the air entering from port 619 at the bottom of the transfer passage 11 flows into the transfer passage 211 clearing the passage 11 of the fresh charge from the previous cycle. The charge and air in the transfer passage 211 flows into the crankcase 26 through the crankcase port 222 at the lower end of the transfer passage 211. It may be observed that the location of the ports 619 and 222 at are a different heights, While 619 is opened closed by the crank web 21, the port 222 may be either fully open all the time or may be closed by the piston as the piston descends toward BDC. Depending on the air inlet timing, the air may partially fill the transfer passage 211 after completely filling the transfer passage 11 or fill it completely. The intake of air-fuel mixture occurs in a normal way through the carburetor 34, charge control valve 80, inlet passage 107 and the inlet port 84. The inlet port 84 opens later during the intake process after the start of induction of air into the transfer passage. The delay in charge inlet timing ensures filling of transfer passage 11 and at least partially the transfer passage 211 with pure air for an effective air-head scavenging. The carburetor may be a double barrel carburetor having a air-fuel butterfly valve to control air-fuel mixture to the inlet port to the cylinder and an air only butterfly valve to control pure air to the crankcase chamber through the air passage, and a link interconnecting the butterfly valves as illustrated in FIGS. 12 and 13.

During the scavenging process, the transfer ports 33 and 233 open simultaneously or may have staggered timing, where port 233 farthest from exhaust port 50, opens a few degrees ahead of port 33. The air flowing from the transfer port 33 acts as a buffer medium between the charge and the burnt gas, thus minimizing the loss of charge into the exhaust. By virtue of crank web being able to provide asymmetric crankcase port timing, the opening of the crankcase port 619 may be delayed while opening the transfer port 33 ahead of 233 to have a blow down of exhaust gas into the transfer passage 11 without adversely effecting the crankcase pressure. When the air is discharged later during the scavenging process, it may trap a layer of burnt gas between the fresh charge and the air, which ensures better trapping of the charge. This minimizes the loss of charge into the exhaust, which lowers the engine out emission of unburned fuel.

It is also possible in a quadruplet transfer passage system for only the transfer passage 11 closest to the exhaust port to receive air while the transfer passage 211 is not in communication with passage 11. In that case the piston may have a window for gaseous communication between transfer passage 11 and the crankcase 26 during intake of air into the transfer passage 11. The piston with a window is shown in FIG. 17(*f*).

FIGS. 17(*a*) through 17(*f*) illustrate different piston configurations usable with the exemplary embodiment, described above. In the case of a quadruplet transfer passages the piston 17(*e*) provides communication between the transfer ports 33 and 233 through an annular piston passage 103 illustrated as an annular groove in the piston. The height of the passage 103 determines the duration of the communication between the ports 33 and 233. Similarly a window 104 illustrated in FIG. 17(*f*) provides passage between the transfer port 33 and the crankcase 26 for filling the transfer passage 11 with pure air during air intake timing. FIG. 17(*b*) and FIG. 17(*c*) illustrates a long passage on the piston skirt 17. The length of the piston passage 102 (612 ) may help prevent reverse flow of charge into the transfer passage when the piston is descending.

FIG. 17(*c*) illustrates a piston passage 612 with a fluid diode 615 which offers resistance for reverse flow of charge into the transfer passage 11 while offering no resistance or minimum resistance for the flow in one direction (toward crankcase). In a quadruplet transfer passage, any combination of the piston configurations may be used. In the sense that the piston may provide gaseous communication during early or late phase of air intake into transfer passages while providing a window or direct passage into crankcase during early or late intake phase of air into transfer passage.

Figure 16:
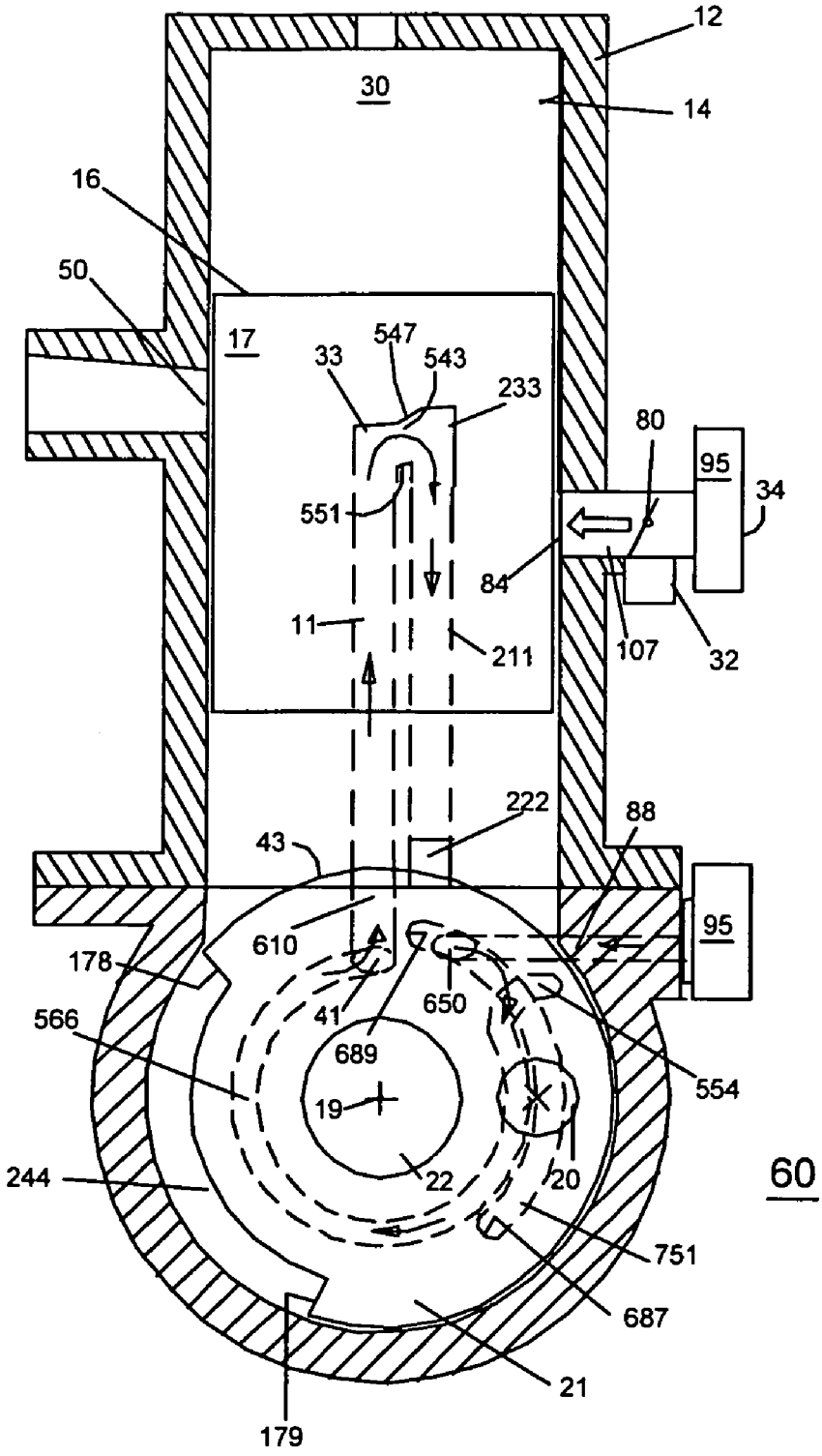
FIG. 16 is a longitudinal sectional view illustration of an exemplary embodiment of a two-stroke engine 60 with quadruplet transfer passages and rotary valve controlled air inlet system with air inlet open condition, has a passage between the two transfer passages at the top.
Figure 17:
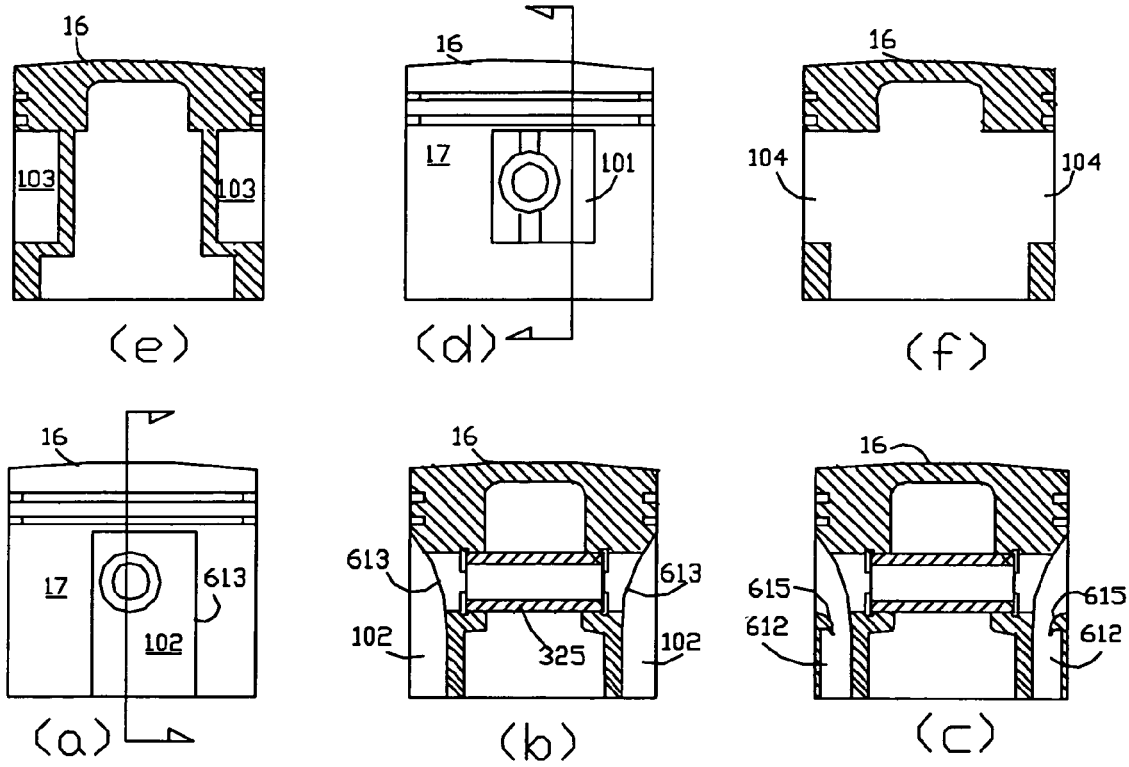
FIG. 17(*a*)–17(*f*) is an illustration of different piston configurations.
Figure 18:
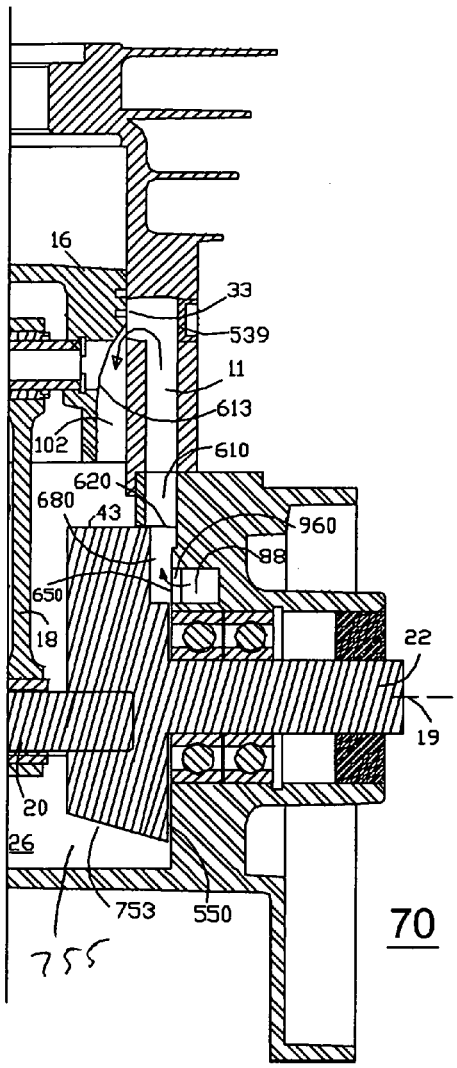
FIG. 18 is a longitudinal sectional view illustration of an exemplary embodiment of a two-stroke engine 70 with transfer passage opened and closed by the valve on the periphery of the crank web and the air inlet port by the cut out on the outside surface of the crank web, the air inlet port is shown open to crankcase through transfer passage and piston passage.
Figure 19:
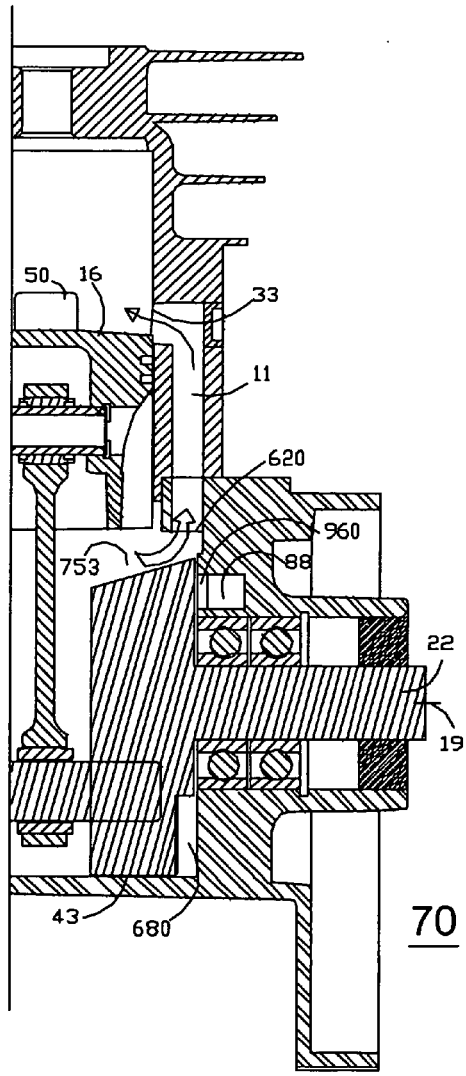
FIG. 19 is a view illustration of FIG. 18 with air inlet port shut off and transfer passage open to crankcase. And transfer port open to combustion chamber.
Figure 20:
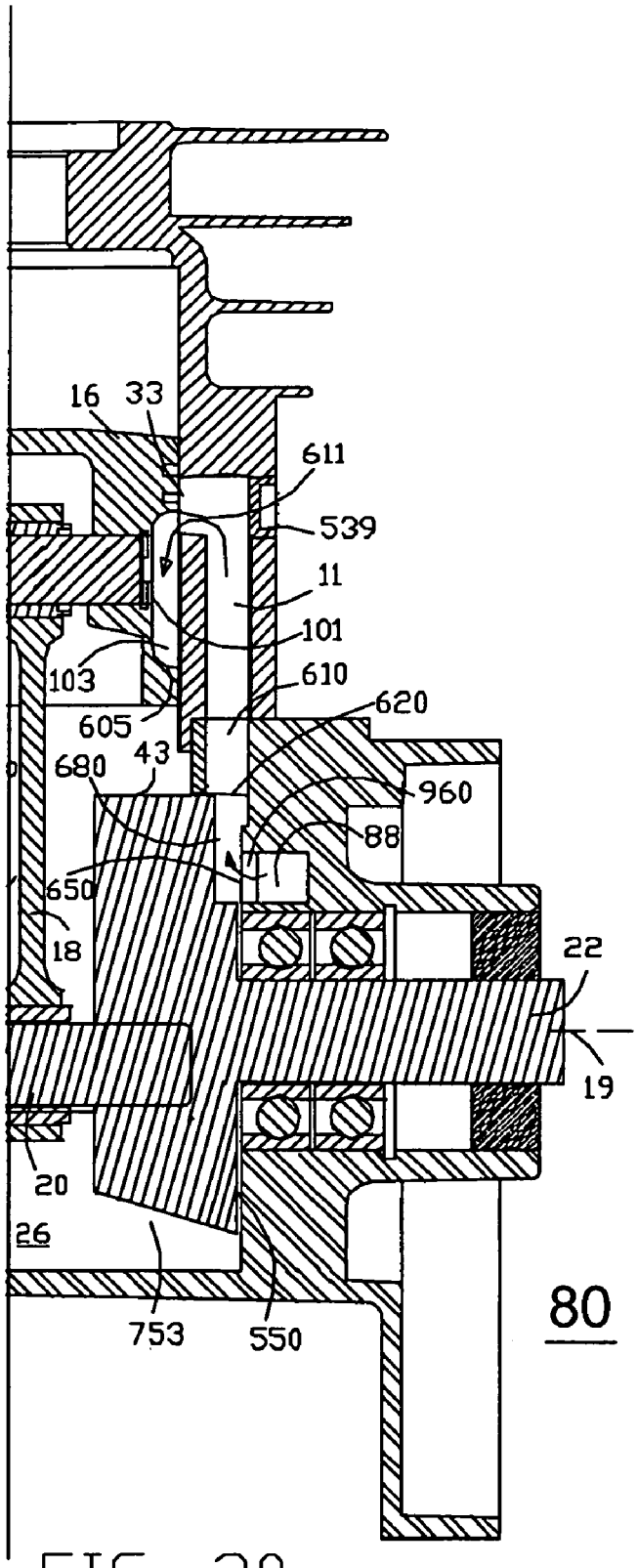
FIG. 20 is a longitudinal sectional view illustration of an exemplary embodiment of a two-stroke engine 80 with transfer passage opened and closed by the valve on the periphery of the crank web and the air inlet port by the cut out on the outside surface of the crank web, and has piston with a closed passage for gaseous communication between the adjacent transfer passages (has quadruplet transfer passages).

FIG. 16 shows where there is no valve to regulate the inlet of pure air into transfer passages. The air inlet has just an air cleaner 95. The inertia of air may keep most of air in the transfer passage 11 and 566 at high speeds, while expelling back some of the air into ambient at idle and low speeds. The air inlet timing may be such that the mass of air trapped in the passage may be proportional to engine speed and or load. Thus it may eliminate the need for expensive double barrel or butterfly valve type carburetor in an air-head scavenged engine.

Figure 1:
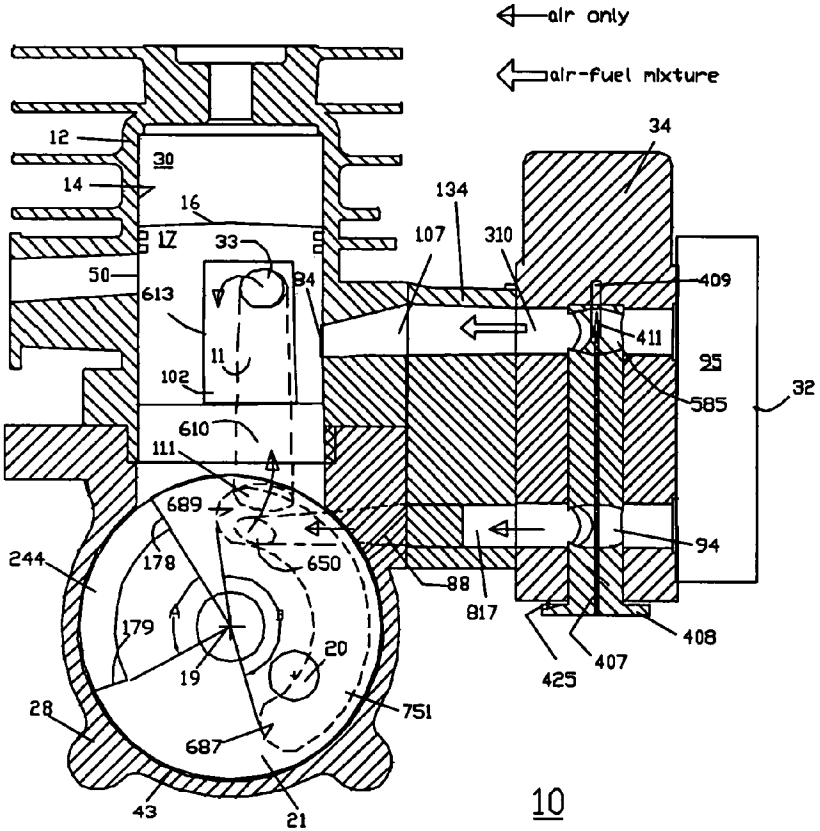
FIG. 1 is a longitudinal sectional view illustration of an exemplary embodiment of a two-stroke engine 10 with a rotary valve controlled air inlet system with air inlet open condition (connecting rod and piston pin not shown).
Figure 4:
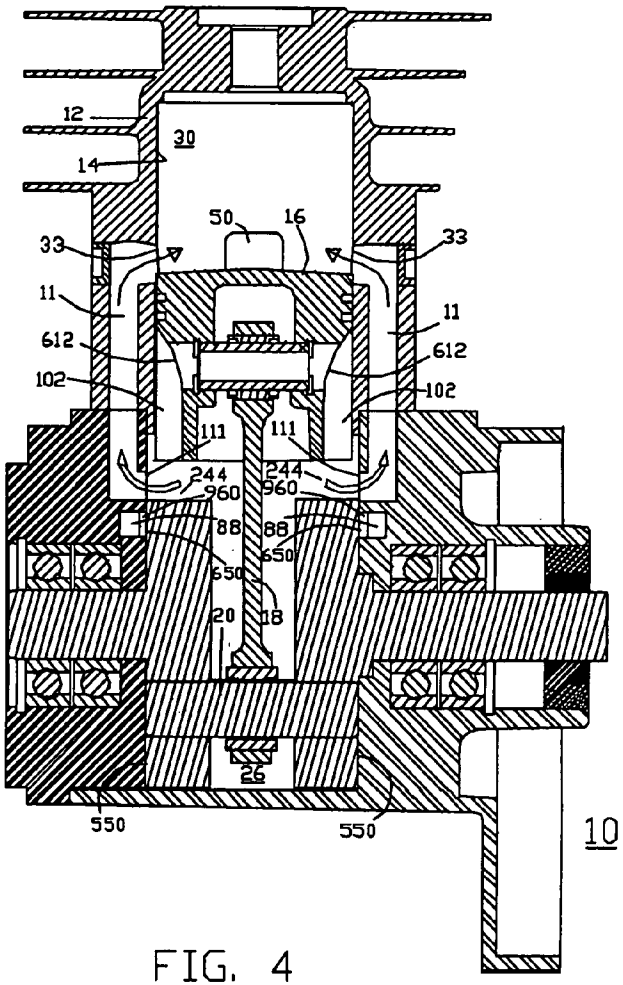
FIG. 4 is a section along the crankshaft of the engine shown in FIG. 3.
Figure 3:
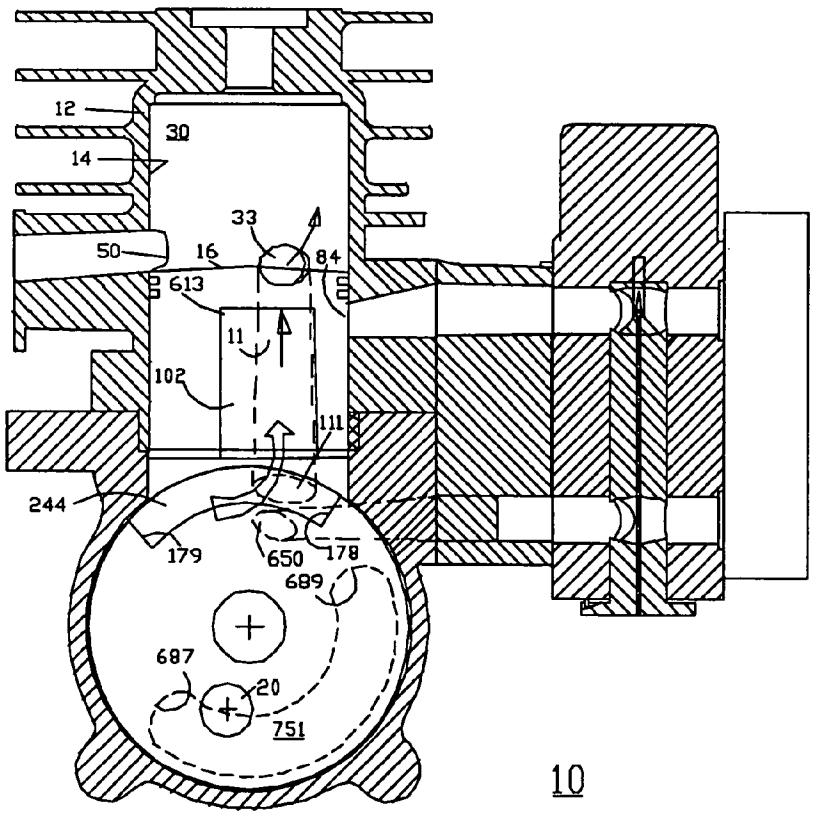
FIG. 3 is a sectional view illustration of the engine 10 illustrated in FIG. 1 when the air inlet is closed and crankcase open to transfer passage for scavenging.
Figure 5:
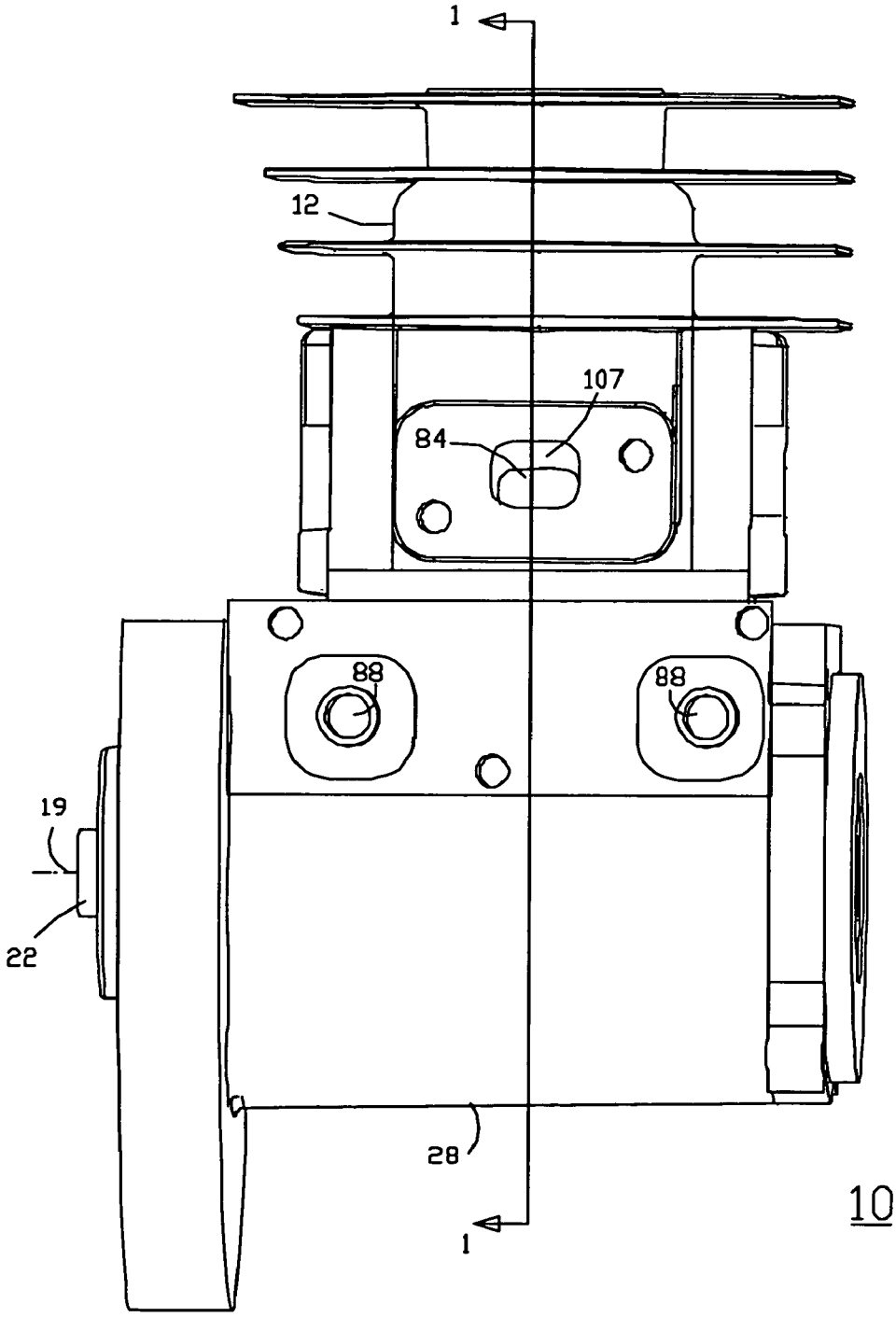
FIG. 5 is a front view of the engine shown in FIG. 1. Carburetor not shown.
Figure 21:
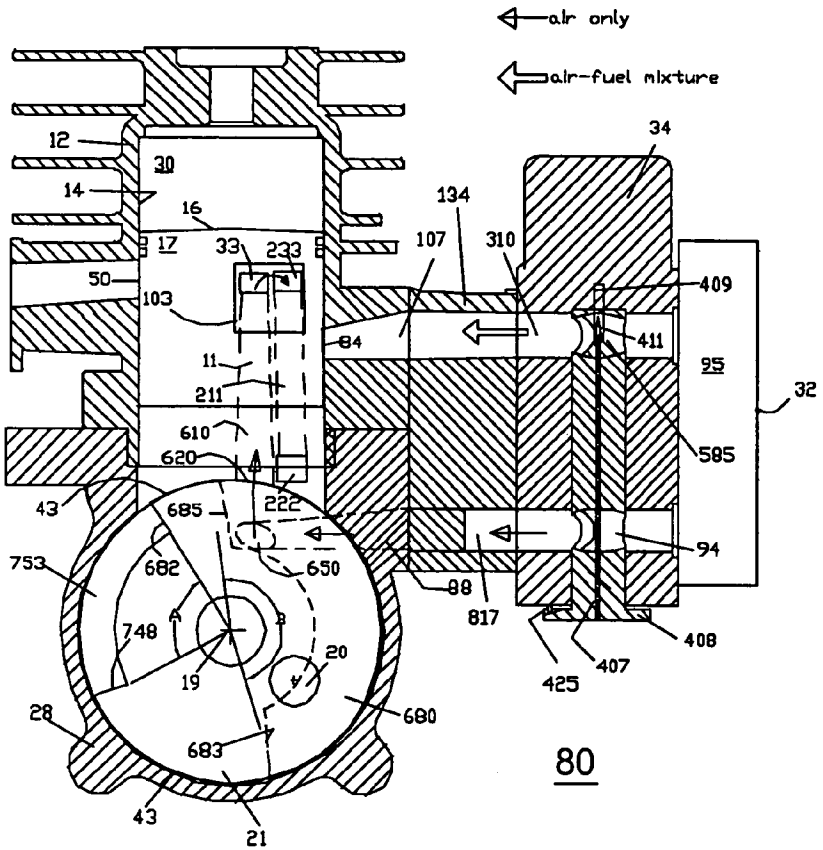
FIG. 21 is a section along the crankshaft of the engine 80 shown in FIG. 20, with air inlet into the crankcase through a pair of transfer passages.

The air and air-fuel control valves can either be a barrel valve type shown in FIGS. 1, 8, and 21 or a butter fly valve type shown in FIGS. 12 through 15.

In FIG. 16, the passage 543 between the transfer passage 11 and 211 is of unique shape. The top face 547 of the passage 543 and the lower face 551 are at an angle to the horizontal plane. The angles are such that when the transfer port 233 opens first it may provide a stratified charge discharge through the port 233 where some of the air in the transfer passage 11 is also discharged through the port 233 while maintaining a stratified layer of air and charge. Also, after the port 33 is open, the discharge in the ports 33 and 233 are such that the charge do not flow into the transfer port 33, while flow of charge through 233 may draw some air from the passage 11. Thus a layer of air may be provided between the charge flowing into chamber 30 and the burnt gas escaping into the exhaust port 50. The same objective may also be achieved by the passage illustrated in FIGS. 23 and 24.

Figure 15:
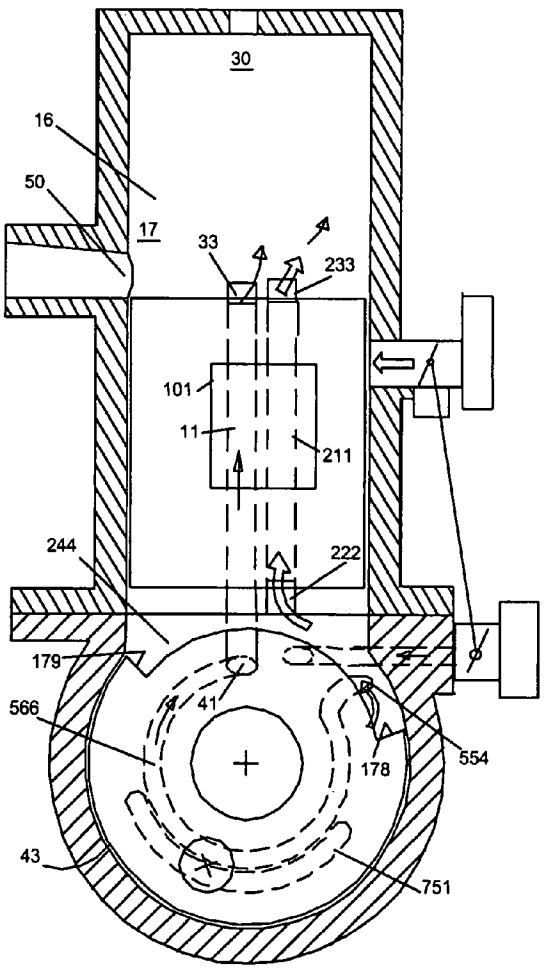
FIG. 15 is a view illustration of FIG. 14 with air inlet closed and lower end of both the transfer passages open to crankcase.
Figure 14:
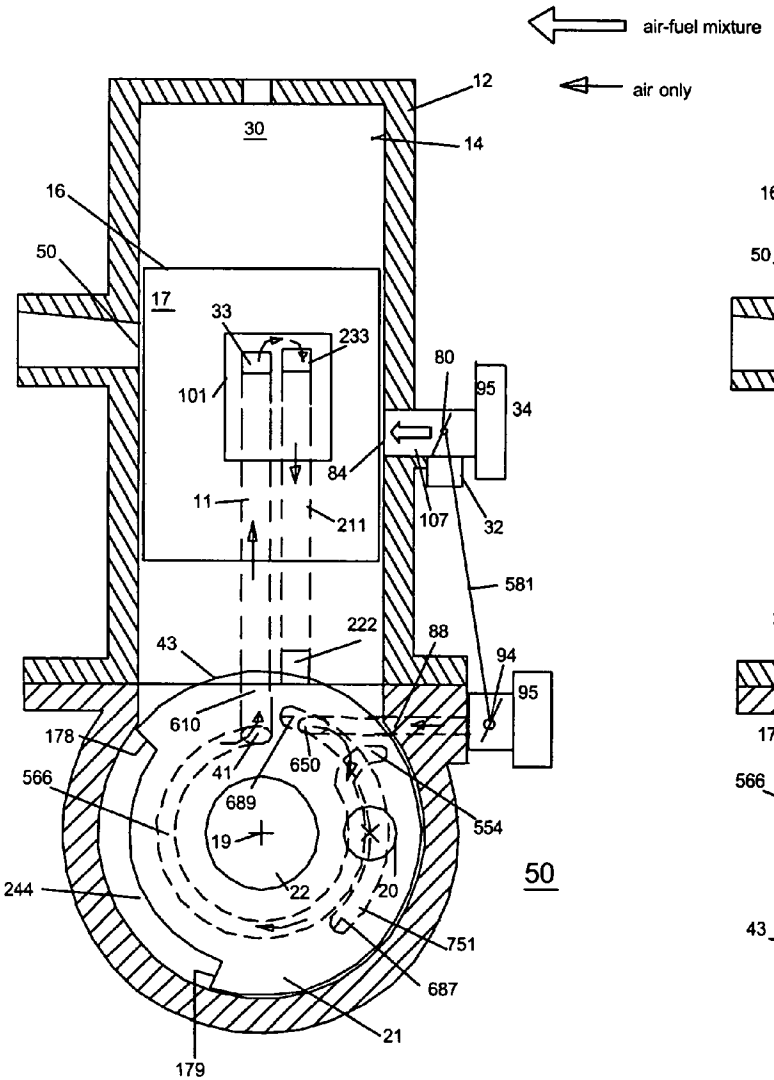
FIG. 14 is a longitudinal sectional view illustration of an exemplary embodiment of a two-stroke engine 50 with quadruplet transfer passages and rotary valve controlled air inlet system with air inlet open condition, has long transfer passages on the crankcase wall.

In FIGS. 14 through 16, the lower end of the transfer passage 11 has a crankcase port 41. A passage around the crankshaft axis in the side walls of the crankcase 28 in the form of a channel 566 enclosed by the side face 550 of the crank web 21. The intent of the long channel on the side walls of the crankcase 28 is to provide a compact but long transfer passage that holds a larger mass of pure air. One end of the channel 566 communicates with the crankcase port 41 and the other end has a 'L' shaped tip and an outlet 554 for gaseous communication with the air inlet port 650 through a cut out (recess) 751 on the outer face 550 of the crank web 21. The functioning of the air intake and scavenging is identical to the description provided earlier for FIGS. 1 through 11. However, the crankcase port 41 remains closed all the time by the crank web. During the intake of air, the ambient air is in gaseous communication with the transfer passage 11 for induction of air through the air inlet port 650, cut out 751 in the crank web, and the channel 566 at the midsection of the 'L' shaped tip, as shown in FIGS. 14 and 16. During the scavenging process, the cut out 244 opens the tip of 'L' section at the port 554, as shown in FIG. 15.

FIGS. 18–23 illustrate an exemplary embodiment of a two-stroke engines with an alternative rotary valve design, where in the transfer passage port 620 is opened and closed to the crankcase by a conical cut out sector 755 in a periphery 753 of the crank web 21 while the air inlet port 650 is opened and closed by the outside surface and a notched cut out 680 on the crank web 21. The crankcase port 619 is at an angle to the side wall of the crankcase. In the sense that the port 620 is directly at the lower end of the transfer passage 11. Where as in FIGS. 1 through 16 ports 111 and 619 are on the sidewall of the crankcase.

The lower end of the transfer passage 11 has a crankcase port 620 that is alternatively in gaseous communication with the ambient air through the cutout 680 on the outside face 550 of the crank web 21 and an air inlet port 650. The crankcase port 620 is also alternatively in gaseous communication with the crankcase 26. The crankcase port 620 is opened into the crankcase 26 by the cutout 753 on the periphery 43 of the crank web 21. The lower end of the second transfer passage 211 is in gaseous communication with the crankcase 26 through a crankcase port 222 (shown in FIGS. 12 through 16 and FIGS. 21 and 22). Crankcase port 222 may or may not be controlled by the piston skirt, particularly as the piston approaches BDC.

As the piston 16 moves upward, the top edge of the piston skirt 17 closes the transfer port 33 first, 233 next and then the exhaust port 50. Both the transfer ports 33 and 233 may be closed simultaneously if the transfer port timing is not staggered (in the sense one port opens earlier than the second). After the exhaust port 50 is closed the crank web shuts off the communication between crankcase port 620 and the crankcase 26. As the piston continues to move upward the air inlet port 650 is opened by the cutout 680 and a little later the cutout 680 opens the crankcase port 620, while the section of the crank web has shuts off direct flow of gas between crankcase port 620 and the crankcase 26. However, the top of the transfer passage 11 can be in gaseous communication with the crankcase 26 either 1) directly through passage 102 in the piston (shown in FIGS. 2 and 18), 2) through closed passage 103 in the piston into the adjacent transfer passage 211 (shown in FIG. 20), 3) through a passage 542 between the transfer passages 11 and 211 (shown in FIGS. 23 and 24, or 4) a open passage 543 (shown in FIG. 16 or a combination of any of the above.

Figure 22:
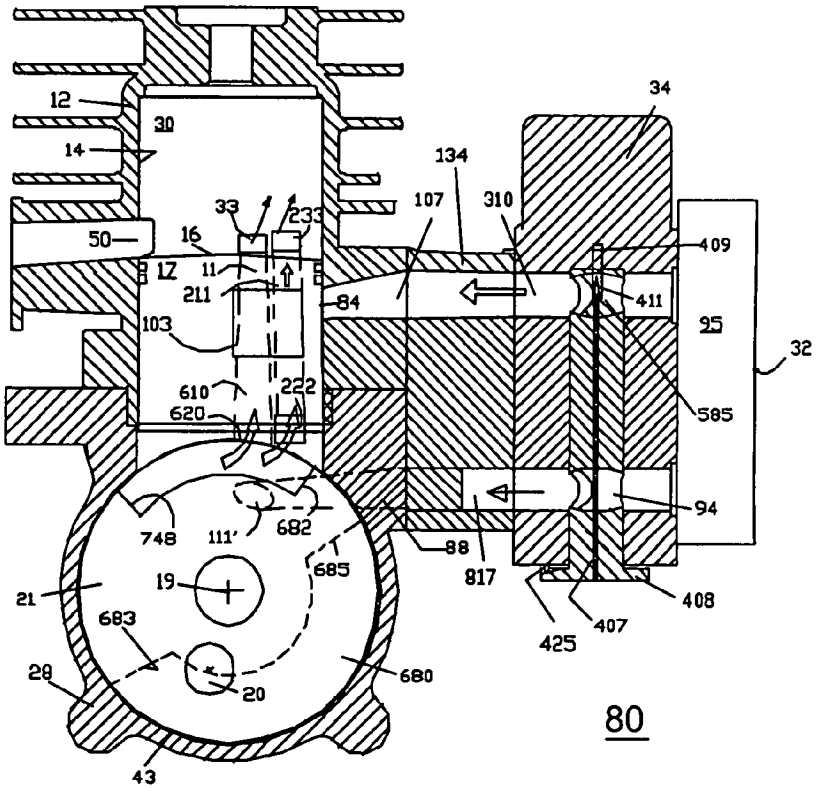
FIG. 22 is a section along the crankshaft of the engine 80 shown in FIG. 20 with piston at BDC; the crank web shuts off air inlet.
Figure 23:
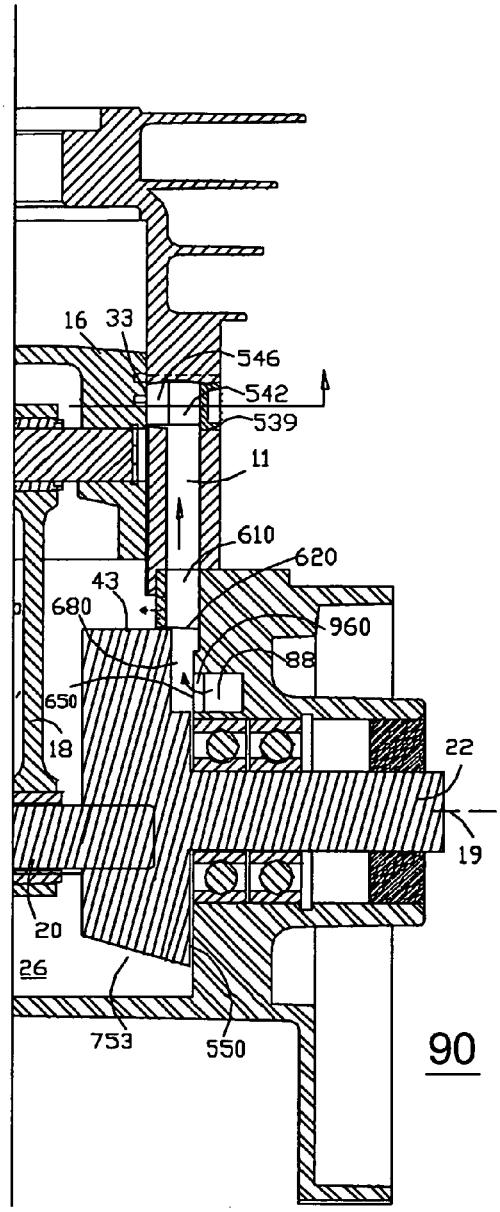
FIG. 23 is a longitudinal sectional view illustration of an exemplary embodiment of a two-stroke engine 90 with transfer passage opened and closed by the valve on the periphery of the crank web and the air inlet port by the cut out on the outside surface of the crank web, and the adjacent transfer passages are in gaseous communication at the top and one of them has rotary valve controlled port at the lower end (has quadruplet transfer passages).

As the piston continues to move upward, the sub-atmospheric pressure in the crankcase 26 draws air from ambient (outside the crankcase) into the transfer passage 11 through the air inlet passage 88, air inlet port 650, and into the crankcase port 620 shown in FIG. 21 through 23. The air then passes through the transfer passage 11 and into the crankcase 26 either directly through piston passage 102 or into the adjacent transfer passage 211. As the crankshaft continues to rotate and the piston moves past TDC, the air inlet port 650 is closed by the crank web outer face 550. And a little later the crank web also closes the crankcase port 620 in FIG. 21 through 23. The intake of air-fuel mixture called the charge occurs in a usual manner through the charge intake port 84. The timing of the charge inlet may occur later than a conventional engine. Delayed intake opening for charge helps fill the transfer passage 11 with pure air. As the air is filled into the transfer passage, the passage 11 (and 211 in a quadruplet transfer passage system) is cleared of the charge from the previous cycle.

As the piston starts to move downward the charge in the crankcase 26 is pressurized. If the crankcase port 620 is not closed, then the fresh charge may enter the transfer passage 11. However, since the crank web closes the crankcase port, the charge does not enter the transfer passage from the lower end. In a quadruplet type transfer passage and when the air is contained in both the transfer passages 11 and 211, closing the crankcase port 620 prevents the reverse flow of air into the crankcase 26. However, charge may enter the transfer passage 211 through the crankcase port 222. The volume and length of the transfer passage 11 and 211 may be such that even when the charge enters the transfer passage 211, it may not reach the transfer passage 11 as the crankcase port 620 is closed.

In order to completely eliminate the entry of charge into the transfer passage 211, the crankcase port 222 may also be either closed by the crank web or by the piston port, where the piston skirt closes the port 222 until the transfer port 233 is open. The opening and closing of the transfer port in the crankcase (or in the cylinder) has been disclosed in patent application Ser. No. 10/446,393, filing date May 28, 2003 by the same Inventors.

As the piston descends the exhaust port 50 is open first. The transfer port is open next. Since it is the air that is entering the combustion chamber first and has the longest residential time, it is more likely that it is the air that gets short circuited into the exhaust port. Thus the air-head scavenging system minimizes the loss of charge into the exhaust and thus lowers the unburned hydrocarbons in the tail pipe exhaust.

When quadruplet transfer ports are used, most of the air is retained in the transfer passage 11, which is closest to the exhaust port 50. The transfer port 233 farthest from the exhaust port 50 may open first in the case of a staggered transfer ports. In that case, as the top of the transfer port 211 also has some air and it enters the combustion chamber first followed by the charge. The second transfer port 33 may open a few degrees later discharging pure air in front of charge and acts as a buffer medium between the fresh charge and the burnt exhaust gas.

It is possible to open the crankcase port 111 (620) later after the transfer port 33 is open, since the crankcase port is opened and closed by the crank web. Thus an asymmetric timing is possible with the crank web controlled crankcase port system.

Figure 24:
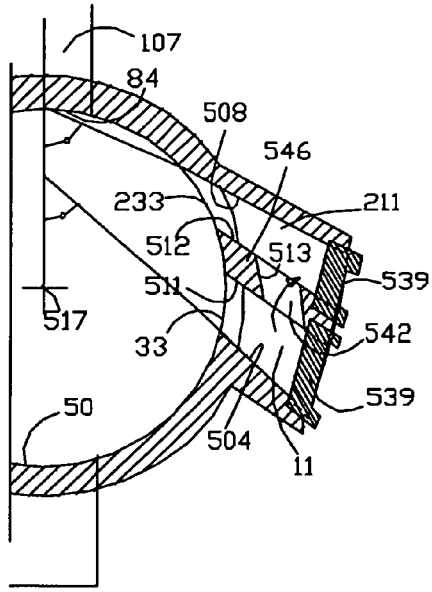
FIG. 24 is a cross sectional view illustration of the cylinder and port arrangement at the top of the engine 90 shown in FIG. 23

In FIGS. 23 and 24, the cap 539 is a plug used after machining the transfer ports 33 and 233 and the connecting passage 542. The included angles between faces 508 & 512 and 511 & 504 are important and they may converge close to the cylinder wall opposite the exhaust port. The included angle between the face 512 and the imaginary plane passing through cylinder axis 517 and the center of exhaust port 50 is such that the flow forces the charge flowing through transfer port 233 to be as close to the cylinder wall opposite the exhaust port as possible. The included angle between face 504 and the similar imaginary plane passing through 517 and center of exhaust port 50 is smaller than the angle formed by the face 512.

FIG. 24 illustrates a cross sectional view of a quadruplet port type transfer passage arrangement. In that, there are pair of transfer passages 11 and 211 on each side of the exhaust port 50. And there is a pair of transfer ports 33 and 233 associated with each pair of transfer passages respectively. In the exemplary embodiment the transfer passages 11 and 211 are interconnected at the top by a passage 542 and has a bridge 546 between the two ports 33 and 233 that separates the two transfer ports 33 and 233. The interconnecting passage 542 has a diverging shape with a face 513 diverging toward the port 233 so as to prevent reverse low from passage 211 into 11 during scavenging. The passage 542 may be of different shape also so as to prevent or minimize the flow of media from passage 211 into 11. The passage 542 may also be an insert with a fluid diode that allows a free flow of air from passage 11 to passage 211, while resisting the reverse flow of charge from passage 211 into 11. It may also have a one way valve between the passage 11 and 211.

Figure 25:
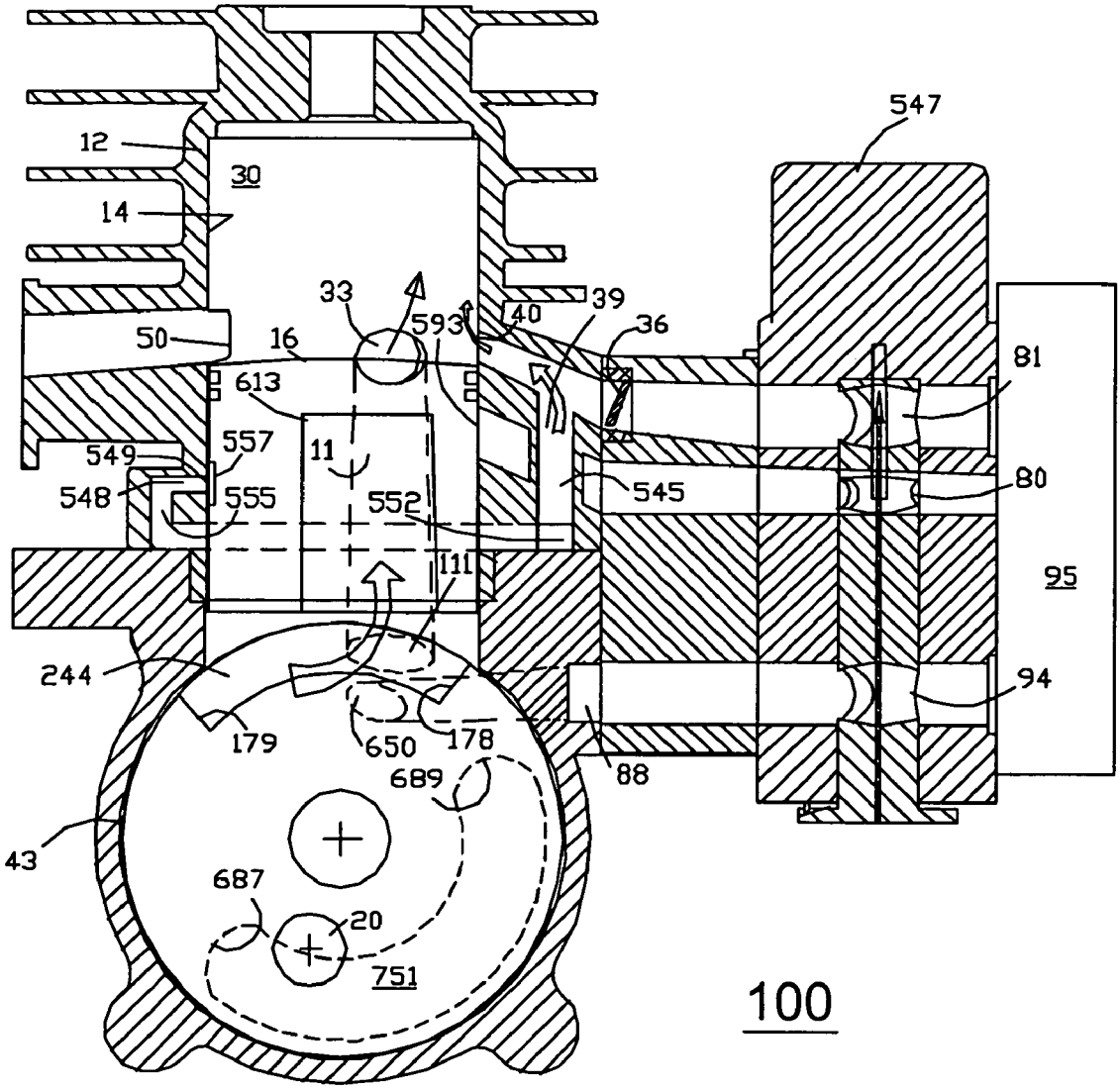
FIG. 25 is a cross sectional view illustration of an exemplary embodiment of a two-stroke engine 100 with three-way scavenging, lower end of transfer passage opened and closed by the crank web for air inlet and piston skirt opens and closes a charge passage for charge injection.

In FIG. 25 the function of the air inlet is similar to the description for the operation of engine shown in FIG. 1. However, in addition to the air, a rich charge system is added where a very rich air-fuel charge is inducted and injected into the combustion chamber 30 through a separate charge passage 39. The engine consists of a three-way carburetor 547 and a three-way scavenging system. The charge passage 39 consists of segments 545, 552,555 and 548. Segment 545 has a charge injection port 40 at the top end open into the combustion chamber 30. The port 40 is opened and closed by the piston. The segment 545 runs down in the cylinder 14 into the segment 552, which is a channel on the cylinder flange 430. The channel 552 runs around the cylinder 14 and opens into the lower end of the segment 555. The charge passage 555 connects into the segment 548, which has a port 549 in the cylinder 12 that opens into the crankcase. The port 549 is opened and closed by the piston 16. The piston skirt 17 has a port 557 to time the start of injection when the piston is descending.

As the piston 16 ascends the piston skirt 17 opens the port 549 and thus establishing gaseous communication between the crankcase 26 and the ambient through the carburetor 547. The rich charge now flows into the charge passage 39 through a one-way valve 36. As the piston continues to ascend the air inlet into the transfer passage 11 and the lean air-fuel charge into the crankcase 26 occurs in a manner described earlier for the engine shown in FIG. 1.

The induction of rich charge into the charge passage 39 ends as the pistons begins to descend. The increase in crankcase pressure forces the one-way valve 39 to close. After the blow down of exhaust gas through the exhaust port 50, the scavenging occurs first through the transfer port 33 where air enters the combustion chamber first followed by lean charge. As the piston continues to descend the crankcase port 111 may be closed and about the same time or before, the window 557 on the piston skirt 17 opens port 549 for injection of charge into the combustion chamber 30. Thus the scavenging process occurs in three phases; first the air enters, followed by the lean charge through the transfer port 33 and then the rich charge is injected through the injection port 40. The transfer passage system may be of quadruplet type described earlier and shown in FIGS. 12, 15, and 21. Also, the air inlet and crank web design may be of any type described in this invention.

FIGS. 29 through 35 illustrate charge injection system where the lower end of the rich charge passage 39 is controlled by the crank web 21 and the top end by the piston 16 for start and end of charge induction into the charge passage. The start and end of charge injection into the combustion chamber may also be controlled by the crank web and have an asymmetric timing.

The carburetor 551 consists of two passages 300 for rich charge and 310 for either only air or very lean charge. The passage 310 opens into the passage 312 in the adapter plate, which communicates into the crankcase through the main inlet port 84. The rich charge passage 300 opens into a charge inlet passage 302, which has a charge inlet port 60 in the crankcase.

Figure 26:
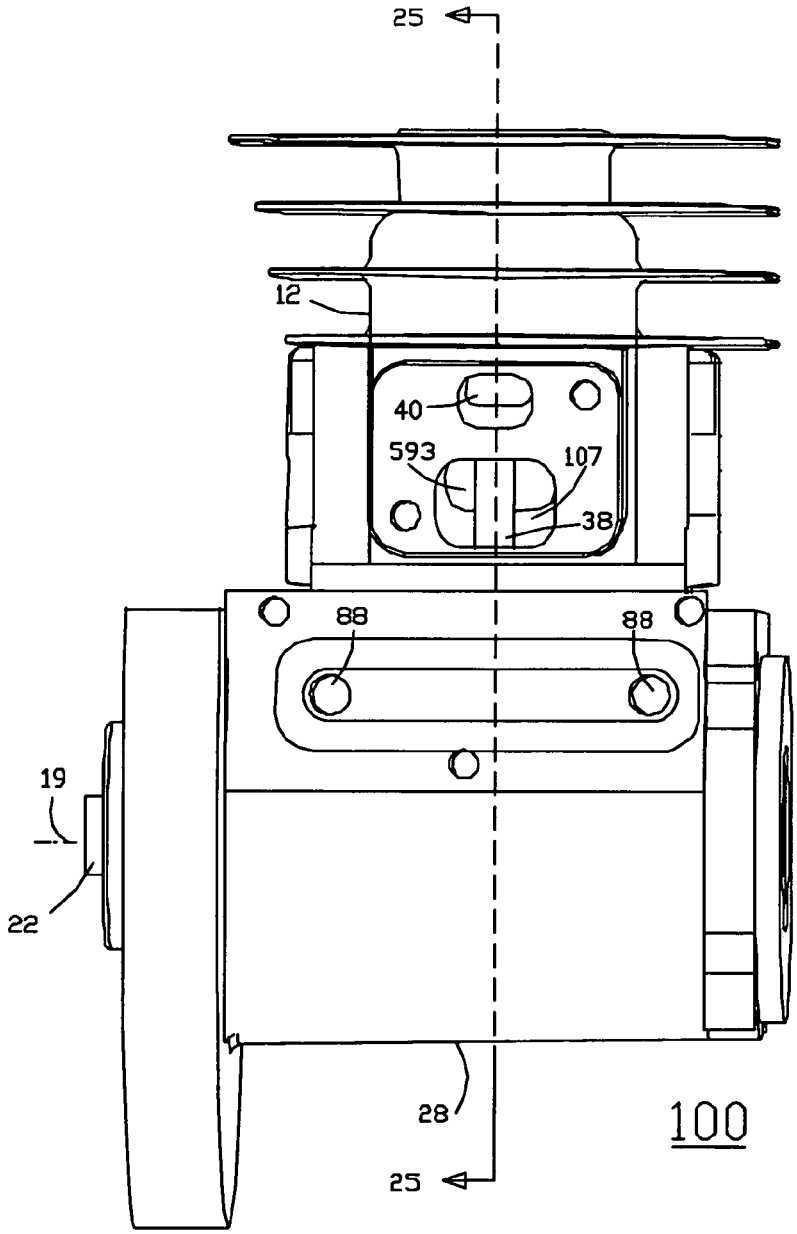
FIG. 26 is a front view of the engine 100 shown in FIG. 25 (carburetor not shown).
Figure 27:
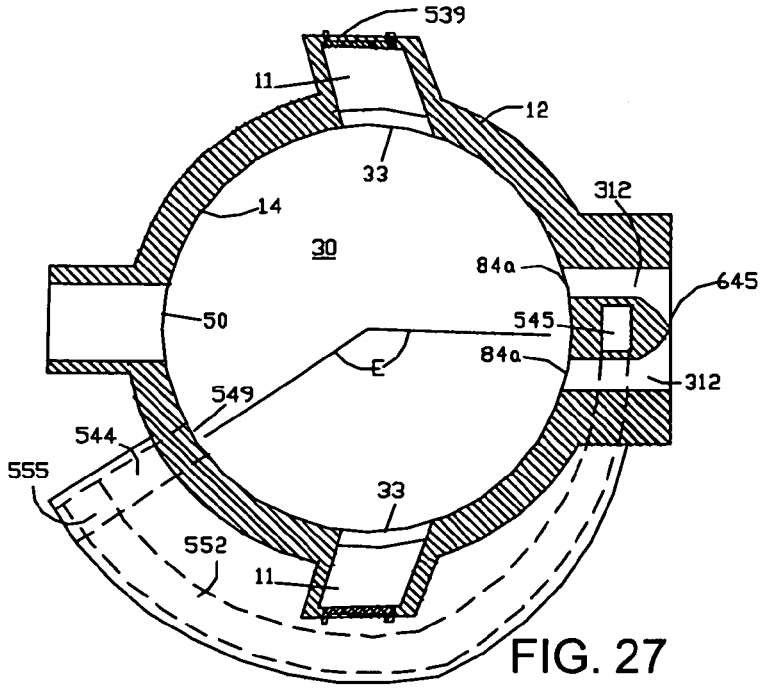
FIG. 27 is a sectional view illustration of the cylinder of the engine shown in FIG. 25.
Figure 28:
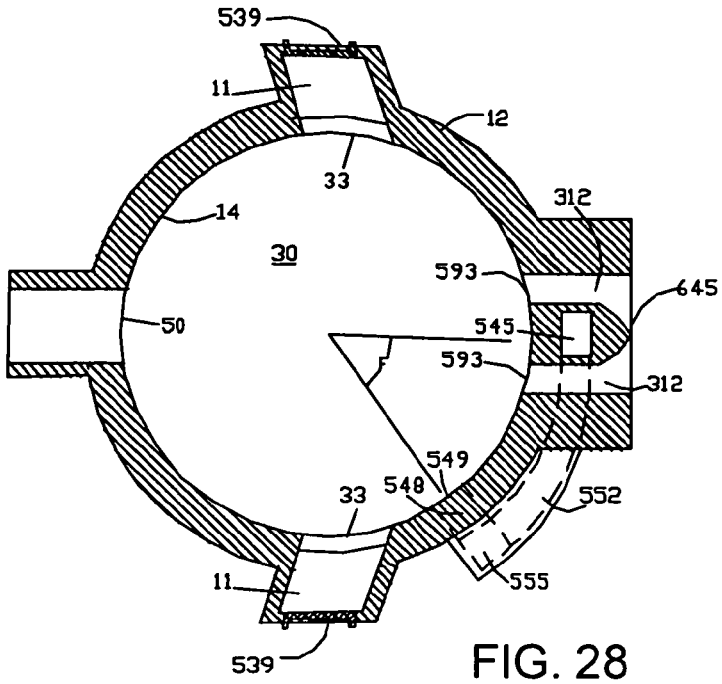
FIG. 28 is a sectional view illustration of the cylinder of the engine shown in FIG. 25, showing alternative location of the charge port 549.
Figure 32:
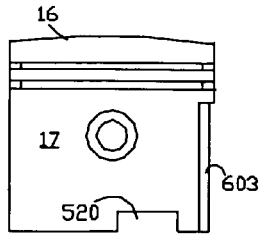
FIG. 32 is a side view elevation of the piston for the engine shown in FIG. 29.
Figure 29:
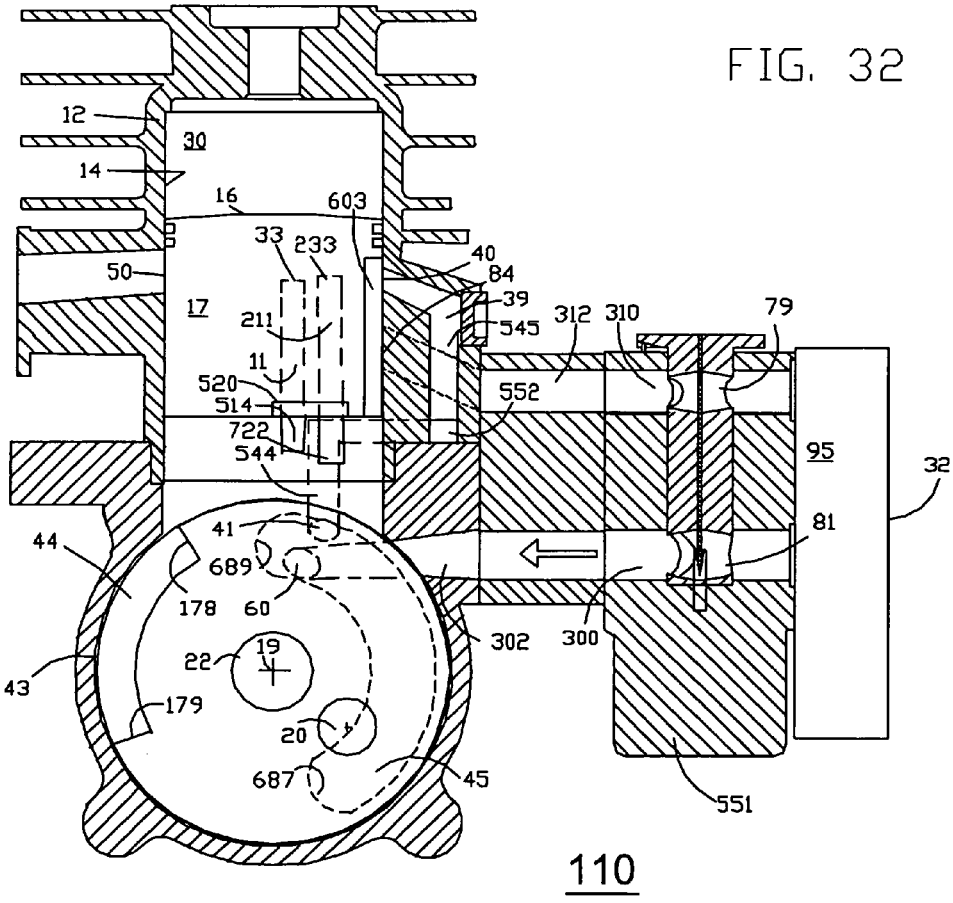
FIG. 29 is a cross sectional view illustration of an exemplary embodiment of a two-stroke engine 110 with lower end of charge passage opened and closed by the crank web for rich charge inlet and piston passage opens and closes the charge passage into the crankcase.
Figure 30:
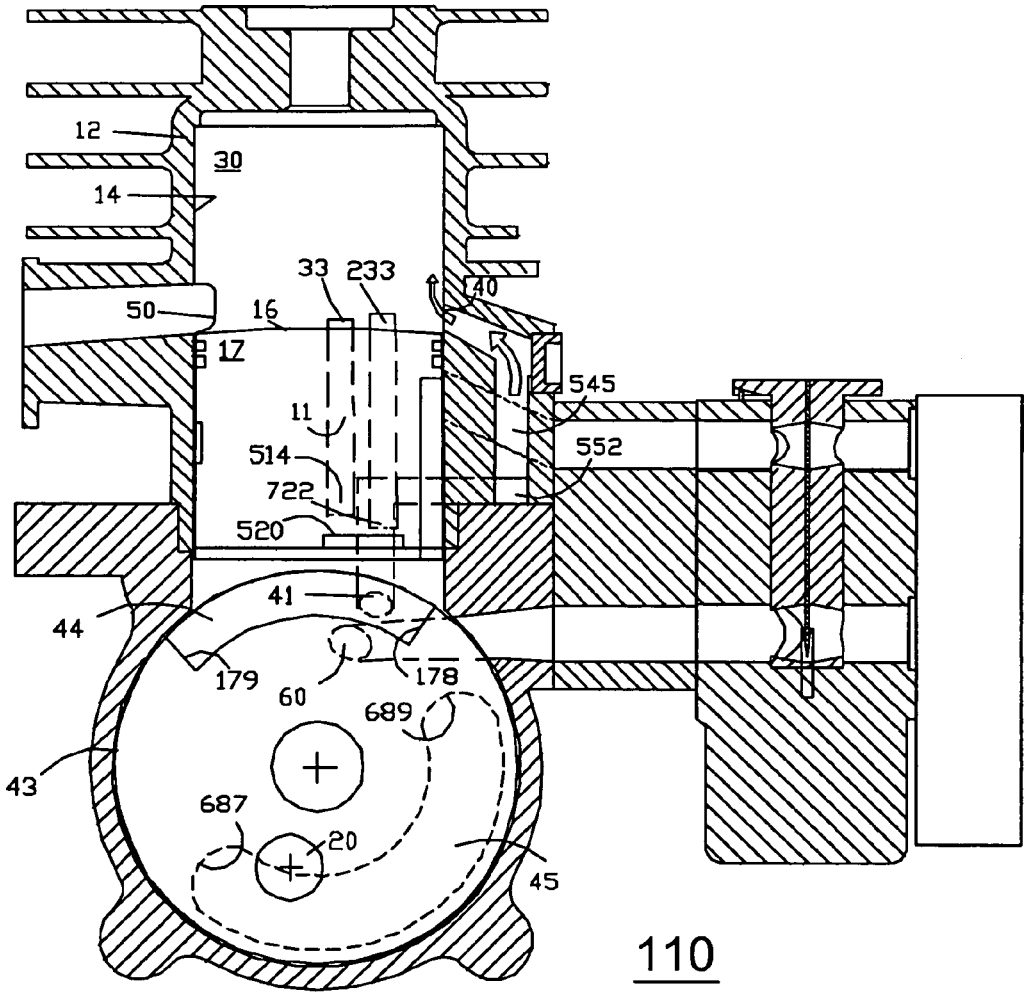
FIG. 30 is a cross sectional view illustration of engine 110 shown in FIG. 29 where piston is near BDC.
Figure 31:
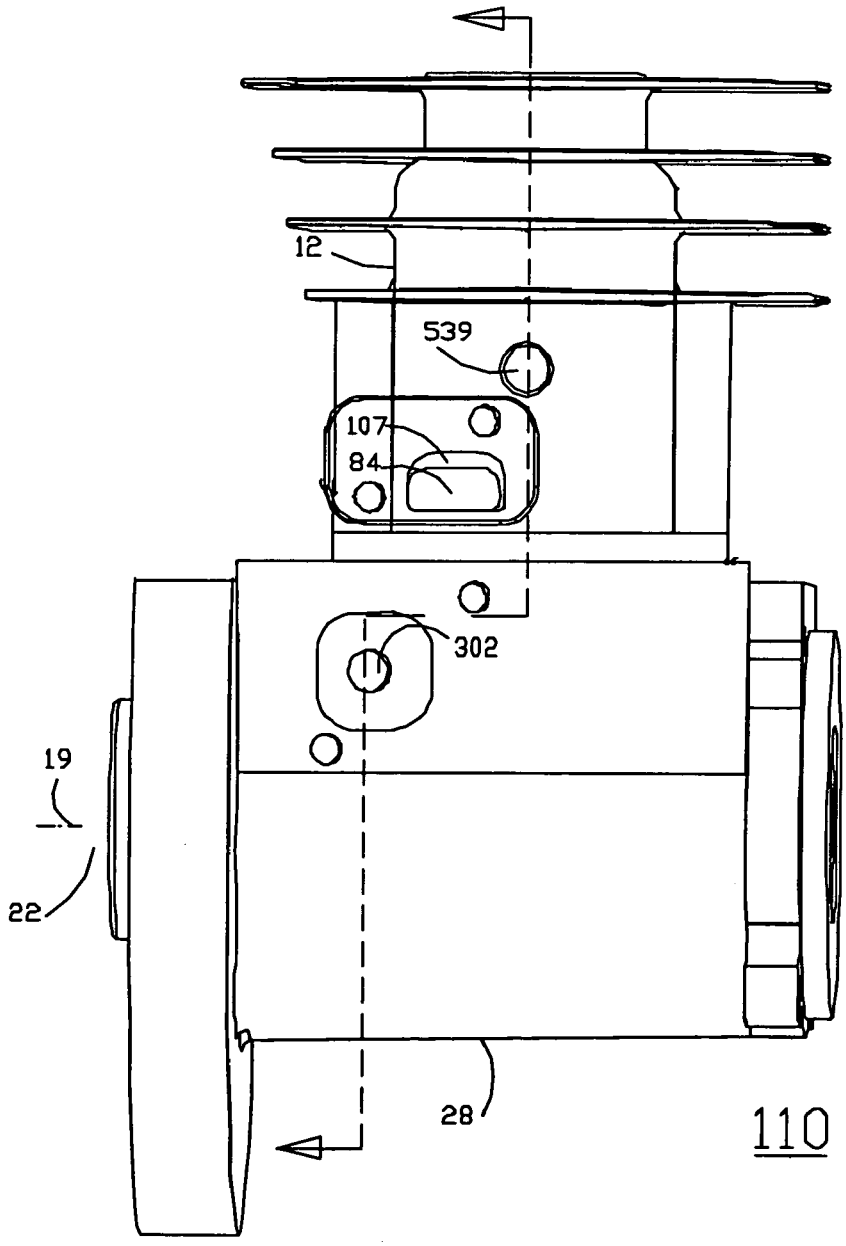
FIG. 31 is a front view of the engine 110 shown in FIG. 29 (carburetor not shown).
Figure 33:
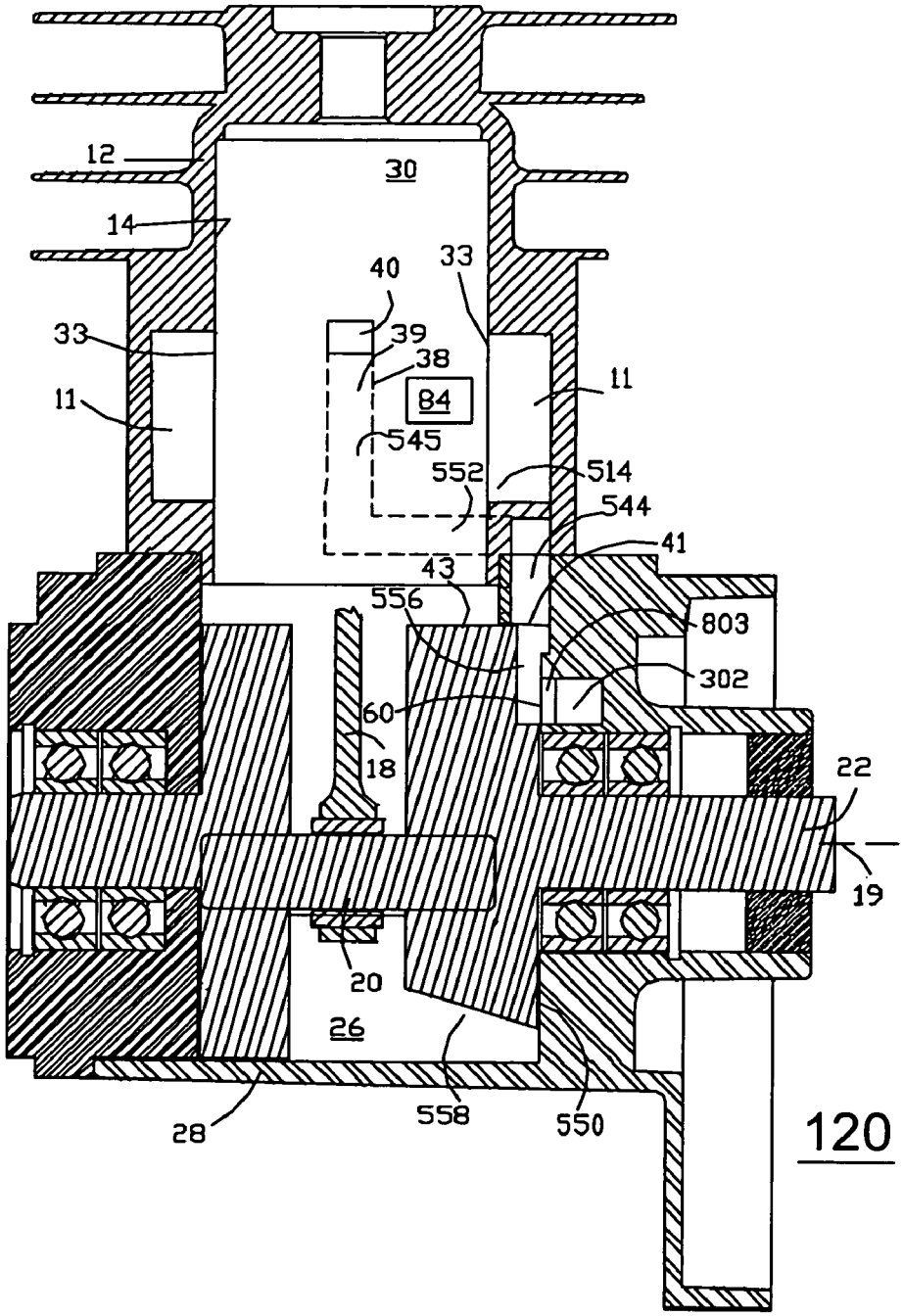
FIG. 33 is a longitudinal sectional view illustration of an exemplary embodiment of a two-stroke engine 120 with charge passage opened and closed by the valve on the periphery of the crank web and the charge inlet port by the cut out on the outside surface of the crank web, the charge inlet port is shown open to crankcase through charge injection port and piston passage.

One end of the charge passage 39 has a charge injection port 40 opening into the combustion chamber where it is opened by the top of the piston 16 during scavenging and injection process. The charge passage 39 has a section 545 running down into the channel 552 in the cylinder flange 430 that runs around the cylinder 14 and opens into the passage 544 in the crankcase. The passage 544 in the crankcase opens into the crankcase 26 through a crankcase port 41 which is opened and closed by the cut outs in the crank web 21. The rich charge passage 302 that is in communication with the carburetor 551 has a charge inlet port 60 in the crank case. The cut out 45 (556 in FIG. 33) on the outside face 550 of the crank web 21 establishes gaseous communication between charge inlet port 60 and the crankcase port 41 when the piston is ascending. The rich charge flows into the charge passage 39 from the lower end of the charge passage and into the crankcase 26 through the charge injection port 40 and through the piston passage 603 (shown in FIG. 32). Thus as the rich charge fills the charge passage 39 it clears the passage 39 of the residual lean charge from the previous cycle. Induction of rich charge ends when the crank web 21 closes the charge inlet port 60 as the piston reaches TDC or past TDC. In the case where the piston has a window similar to the one shown in FIG. 17(*f*), then the height of the piston window determines the duration of induction. The induction of main lean charge or just air into the crankcase 26 occurs in a usual manner through the inlet port 84. The main inlet 84 may be off set from the induction passage 39 as shown in FIGS. 31, 33, 34, and 36 or the inlet passage 84 may be split around the passage 39 as shown in FIGS. 26, 27, and 28.

As the piston descends the piston opens the exhaust port 50 first and the scavenging occurs as the transfer ports 33 and 233 are opened. As the piston descends the crankcase port 41 is opened again by the cut out 44 (558 in FIG. 33) in the crank web for injection. The lower ends 514 and 2514 of the transfer passages 11 and 211 shown in FIGS. 29 and 30 may be shut off by the piston skirt 16 at the piston edge 520 thus forcing the charge and the crankcase content through the charge passage 39 through the charge injection port 40 into the combustion chamber. Thus the control of charge inlet by the crank web eliminates the need for one-way valve 39 (shown in FIG. 25). Also, an asymmetric timing is achieved by the use of crank web for timing the charge induction and injection.

Figure 34:
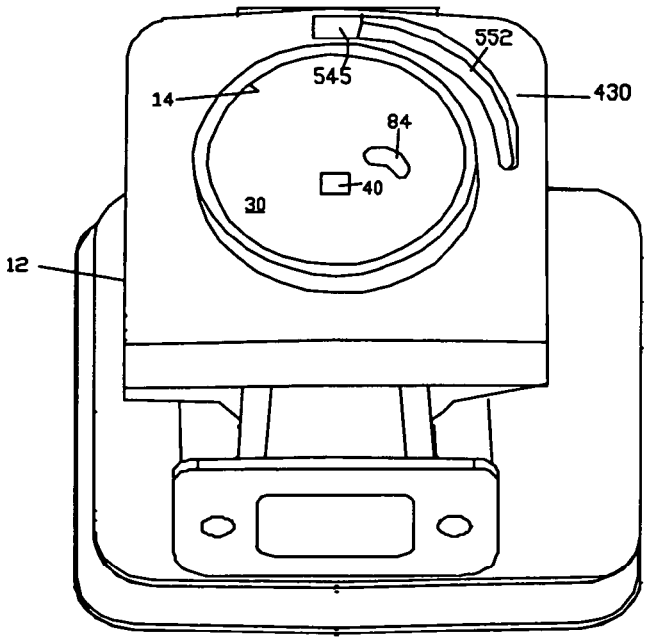
FIG. 34 is an elevation of the cylinder flange for the engine 120 shown in FIG. 31.
Figure 35:
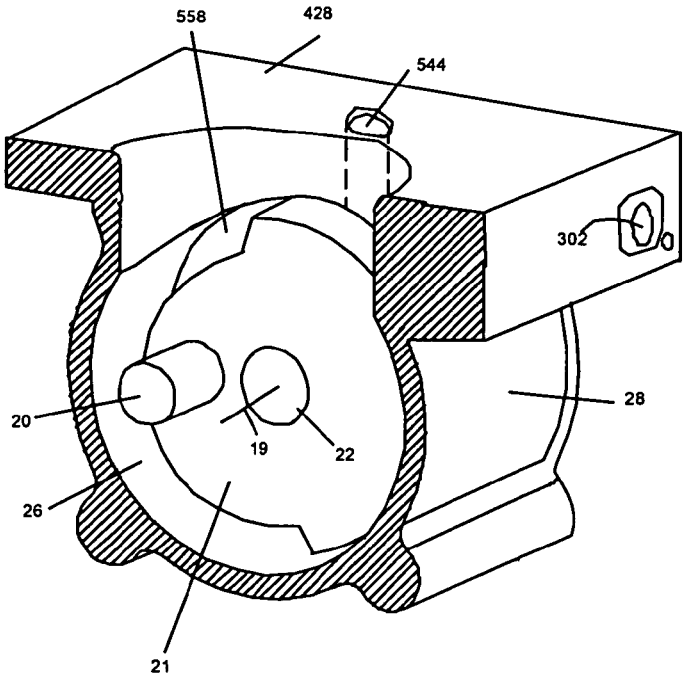
FIG. 35 is a sectional view illustration of the crankcase for the engine 120 shown in FIG. 31.
Figure 36:
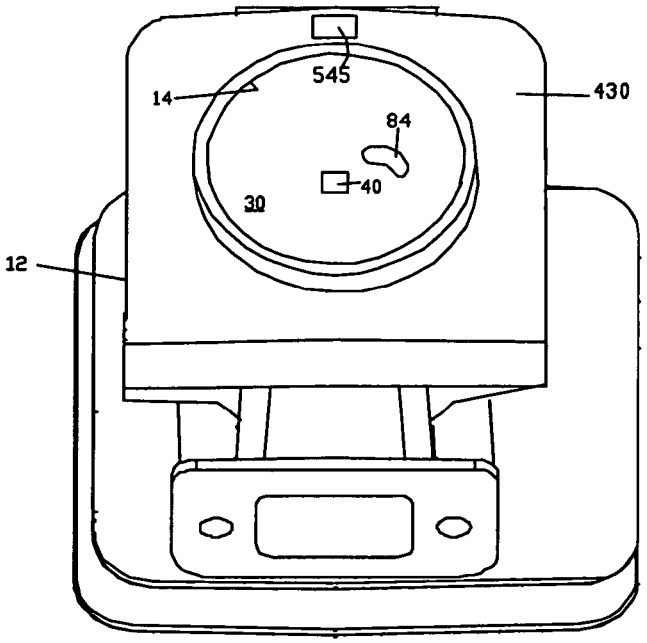
FIG. 36 is an elevation of the cylinder flange without channel in the flange.
Figure 37:
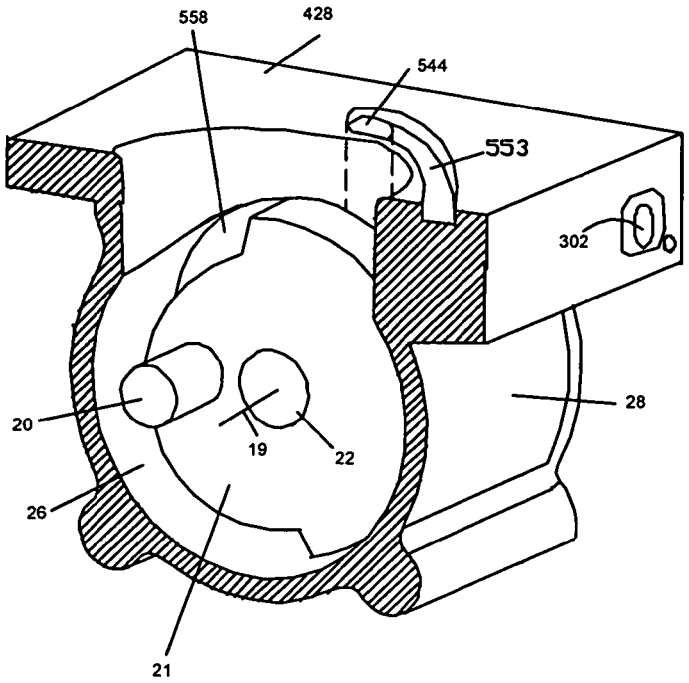
FIG. 37 is a sectional view illustration of the charge passage channel in the crankcase flange for the engine shown in FIG. 36.

The segment 552 of the charge passage 39 may be on the cylinder flange 430 as shown in FIG. 34 with the charge passage 544 in the crankcase 26 shown in FIG. 35. The segment 552 shown as 553 in FIG. 37 may be on the crankcase flange 428 as shown in the Figure and the cylinder that matches this arrangement is shown in FIG. 36.

TABLE 1

| Typical port timings for a quadruplet ported engine for air-head scavenging are: |
|---|
| EPO 50 opens at 100 to 125 aTDC |
| TPO 233 opens at 110 to 135 aTDC |
| TPO 33 opens at 105 to 140 aTDC |
| Crankcase port 111 opens to crankcase at 100 to 130 aTDC |
| Crankcase port 111 closes to crankcase at 20 to 35 aBDC |
| Air inlet port 650 opens at 21 to 37 aBDC |
| Air inlet port 650 closes at 20 bTDC to 30 aTDC |
| Crankcase port 111 open to ambient for air induction at 106 to 139 bTDC |
| Crankcase port 111 closes to ambient at 10 bTDC to 35 aTDC |
| Piston passage opens (connects transfer port to crankcase) at 106 to 30 bTDC |
| Piston passage closes at 106 to 30 aTDC |
| Inlet 84 opens at 65 to 40 bTDC |
| Inlet 84 closes at 65 to 40 aTDC |

TABLE 2

| Typical port timings for a three-way scavenged engine (example FIG. 25) are: |
|---|
| EPO 50 opens at 100 to 125 aTDC |
| TPO 33 opens at 105 to 140 aTDC |
| Crankcase port 111 opens to crankcase at 100 to 130 aTDC |
| Crankcase port 111 closes to crankcase at 40 bBDC to 35 aBDC |
| Charge injection port 40 opens to combustion chamber at 115 to 150 aTDC |
| Charge injection port 40 closes at 115 bTDC to 150 bTDC |
| Port 549 opens at 120 aTDC to 155 aTDC |
| Port 549 closes at 120 bTDC to 155 bTDC |
| Port 549 open for charge induction at 110 bTDC to 145 bTDC |
| Port 549 closes for charge induction at 110 aTDC to 145 aTDC |
| Air inlet port 650 opens at 21 to 37 aBDC |
| Air inlet port 650 closes at 20 bTDC to 30 aTDC |
| Crankcase port 111 open to ambient for air induction at 106 to 139 bTDC |
| Crankcase port 111 closes to ambient at 10 bTDC to 35 aTDC |
| Piston passage opens (connects transfer port to crankcase) at 106 to 30 bTDC |
| Piston passage closes at 106 to 30 aTDC |
| Inlet 84 opens at 65 to 40 bTDC |
| Inlet 84 closes at 65 to 40 aTDC |

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

What is claimed is:

1. A two stroke internal combustion engine comprising:

at least one transfer passage in gaseous communication between a crankcase chamber and a combustion chamber of the engine, an air passage through a crankcase to the crankcase chamber and in gaseous communication with a carburetor of the engine, a rotatable circular disk rotatably connected to a crankshaft of the engine, at least one first rotary shut-off valve located in a radially outermost section of the circular disk bordered by a periphery of the circular disk and operatively disposed between the transfer passage and the crankcase chamber for opening and closing gaseous communication between the transfer passage and the crankcase chamber, at least one second rotary shut-off valve located on the circular disk bordered by a periphery of the circular disk and operatively disposed between the air passage and the transfer passage for opening and closing gaseous communication between the air passage and the transfer passage, and wherein the first and second rotary shut-off valves are operably located on the circular disk to close the air passage to the transfer passage when the transfer passage is open between the combustion chamber and the crankcase chamber and to close off the transfer passage between the combustion chamber and the crankcase chamber when the air passage is opened to the transfer passage.

2. A two stroke internal combustion engine as claimed in claim 1 wherein the rotatable circular disk is a crank web, the first rotary shut-off valve is a conical cut out sector in a periphery of the crank web, and the second rotary shut-off valve is a notched cut out in the periphery of the crank web.

3. A two stroke internal combustion engine as claimed in claim 1 further comprising a piston disposed within a cylinder of the engine and connected by a piston rod to the crankshaft and a window in the piston positioned to open and close a transfer port to the transfer passage between the crankcase chamber and the transfer passage for filling the transfer passage with air during air intake.

4. A two stroke internal combustion engine as claimed in claim 3 further comprising a piston passage in the piston and the piston passage being operably located to connect the transfer port to the crankcase chamber.

5. A two stroke internal combustion engine as claimed in claim 3 further comprising a piston passage through the piston and the piston passage being operably located to connect the transfer port to the crankcase chamber.

6. A two stroke internal combustion engine as claimed in claim 5 further comprising a fluid diode in the piston passage which offers resistance for reverse flow of charge into the transfer passage while offering no resistance or minimum resistance for the flow in a direction toward crankcase chamber.

7. A two stroke internal combustion engine as claimed in claim 6 wherein the fluid diode includes a lip around an upper end of the piston passage near the transfer port.

8. A two stroke internal combustion engine as claimed in claim 3 further comprising an inlet port to the cylinder and the inlet port being positioned to allow air-fuel mixture to directly enter the crankcase chamber as the piston is traveling upward.

9. A two stroke internal combustion engine as claimed in claim 1 further comprising the carburetor being a double barrel carburetor with an air-fuel valve to control air-fuel mixture to the inlet port to the cylinder and a separately controlled air only valve to control pure air to the crankcase chamber through the air passage.

10. A two stroke internal combustion engine as claimed in claim 2, further comprising:

the carburetor being a double barrel carburetor, the carburetor having a air-fuel butterfly valve to control air-fuel mixture to the inlet port to the cylinder and an air only butterfly valve to control pure air to the crankcase chamber through the air passage, and a link interconnecting the butterfly valves.

11. A two stroke internal combustion engine as claimed in claim 1 further comprising:

a piston disposed within a cylinder of the engine and connected by a piston rod to the crankshaft, the transfer passage being a first transfer passage, a second transfer passage, and a piston passage in the piston and the piston passage being operably located to connect the first transfer passage to the second transfer passage.

* * * * *